US010947972B2

(12) United States Patent
Naganuma et al.

(10) Patent No.: US 10,947,972 B2
(45) Date of Patent: Mar. 16, 2021

(54) VARIABLE DISPLACEMENT-TYPE OIL PUMP

(71) Applicant: HITACHI AUTOMOTIVE SYSTEMS, LTD., Hitachinaka (JP)

(72) Inventors: Atsushi Naganuma, Atsugi (JP); Hideaki Ohnishi, Atsugi (JP)

(73) Assignee: HITACHI AUTOMOTIVE SYSTEMS, LTD., Hitachinaka (JP)

( * ) Notice: Subject to any disclaimer, the term of this patent is extended or adjusted under 35 U.S.C. 154(b) by 262 days.

(21) Appl. No.: 15/758,901

(22) PCT Filed: Aug. 12, 2016

(86) PCT No.: PCT/JP2016/073696
§ 371 (c)(1),
(2) Date: Mar. 9, 2018

(87) PCT Pub. No.: WO2017/047303
PCT Pub. Date: Mar. 23, 2017

(65) Prior Publication Data

US 2018/0258930 A1 Sep. 13, 2018

(30) Foreign Application Priority Data

Sep. 18, 2015 (JP) ..... JP2015-184891

(51) Int. Cl.
*F04C 14/22* (2006.01)
*F04C 2/344* (2006.01)
(Continued)

(52) U.S. Cl.
CPC ..... *F04C 14/22* (2013.01); *F04C 2/344* (2013.01); *F04C 2/3441* (2013.01);
(Continued)

(58) Field of Classification Search
CPC ..... F04C 14/223; F04C 14/226; F04C 2/344; F04C 2/3442; F04C 14/22; F04C 14/24;
(Continued)

(56) References Cited

U.S. PATENT DOCUMENTS 4,342,545 A 8/1982 Schuster
2009/0202375 A1* 8/2009 Shulver ..... F01M 1/16 418/26

(Continued)

FOREIGN PATENT DOCUMENTS

EP 1 832 752 A2 9/2007
JP S55-017696 A 2/1980

(Continued)

*Primary Examiner* — Dominick L Plakkoottam
(74) *Attorney, Agent, or Firm* — Foley & Lardner LLP

(57) ABSTRACT

Variable displacement-type oil pump has pump configuration unit driven by engine and discharging oil sucked from inlet portion from outlet portion by volumes of a plurality of pump chambers being varied; cam ring changing volume variation of each pump chamber by moving; coil spring forcing cam ring in direction in which volume variation of each pump chamber is increased; control oil chamber forcing cam ring in direction in which volume variation of each pump chamber is decreased; drain port draining oil from control oil chamber; control valve into which a downstream side oil discharged from outlet portion is introduced, and which adjusts internal pressure of control oil chamber by supplying oil into control oil chamber when hydraulic pressure of the introduced oil exceeds a predetermined setting working pressure. With this configuration, it is possible to suppress increase in electric power consumption associated with an electrical control mechanism.

12 Claims, 15 Drawing Sheets

(51) Int. Cl.
*F04C 15/00* (2006.01)
*F04C 14/24* (2006.01)

(52) U.S. Cl.
CPC ..... *F04C 14/226* (2013.01); *F04C 14/24* (2013.01); *F04C 15/008* (2013.01)

(58) Field of Classification Search
CPC ..... F04C 15/008; F04C 2/3441; F04C 2210/206; F04C 2270/18; F04C 2270/185; F04B 17/05; F04B 49/002
See application file for complete search history.

(56) References Cited

U.S. PATENT DOCUMENTS

| | | | | |
|---|---|---|---|---|
| 2010/0028171 | A1* | 2/2010 | Shulver | F04C 14/226 417/307 |
| 2014/0072456 | A1* | 3/2014 | Watanabe | F04C 2/3442 417/218 |
| 2014/0219847 | A1* | 8/2014 | Watanabe | F04C 2/3442 418/24 |
| 2015/0020759 | A1* | 1/2015 | Watanabe | F01L 1/3442 123/90.15 |
| 2016/0153325 | A1* | 6/2016 | Saga | F01M 1/02 418/24 |

FOREIGN PATENT DOCUMENTS

| | | | |
|---|---|---|---|
| JP | S56-143383 | A | 11/1981 |
| WO | WO-2007/128106 | A1 | 11/2007 |

* cited by examiner

VARIABLE DISPLACEMENT-TYPE OIL PUMP

TECHNICAL FIELD

The present invention relates to a variable displacement-type oil pump that lubricates, for instance, sliding parts in an internal combustion engine and supplies oil as a driving source for auxiliary machinery of the internal combustion engine.

BACKGROUND ART

As a related-art variable displacement-type oil pump, there has been known a variable displacement-type oil pump disclosed in the following Patent Document 1. This variable displacement-type oil pump is a pump that varies a discharge pressure according to an eccentric amount of a cam ring with respect to a rotor (hereinafter, simply called "eccentric amount"). The variable displacement-type oil pump has, at an outer circumferential side of the cam ring, a first control fluid chamber that forces the cam ring in a direction in which the eccentric amount is decreased by the oil being introduced in the first control fluid chamber, a second control fluid chamber that forces the cam ring in a direction in which the eccentric amount is increased by the oil being introduced in the second control fluid chamber, a coil spring that always forces the cam ring in a direction in which the eccentric amount is increased, and a third control fluid chamber that is formed so as to allow the oil to be always introduced in the third control fluid chamber.

The variable displacement-type oil pump further has an electrical control mechanism that switches supply and discharge of the oil to and from the first and second control fluid chambers on the basis of an electric signal. The variable displacement-type oil pump is configured to adjust the discharge pressure to a desired value regardless of an engine rotation speed by the eccentric amount of the cam ring being varied by control of the electrical control mechanism.

In a case of the related-art variable displacement-type oil pump, however, since it is required to always control hydraulic pressures of the first and second control fluid chambers by the electrical control mechanism when maintaining the discharge pressure to the desired value, electric power consumption associated with the electrical control mechanism is increased, and this might result in poor fuel economy.

CITATION LIST

Patent Document

Patent Document 1: International Application Publication No. WO2007/128106A1

SUMMARY OF THE INVENTION

The present invention was made in view of the above technical problem. An object of the present invention is therefore to provide a variable displacement-type oil pump that is capable of suppressing increase in the electric power consumption associated with the electrical control mechanism.

A variable displacement-type oil pump comprises: a pump configuration unit that is driven and rotates by an engine and discharges oil sucked from an inlet portion from an outlet portion by volumes of a plurality of pump chambers being varied; a movable member that is able to change a volume variation of each of the plurality of pump chambers by movement of the movable member; a forcing mechanism that is installed with a set load provided and forces the movable member in a direction in which the volume variation of each of the plurality of pump chambers is increased; one or more control oil chambers that changes the volume variation of each of the plurality of pump chambers, the control oil chambers including at least a decrease side control oil chamber that exerts a force on the movable member in a direction in which the volume variation of each of the plurality of pump chambers is decreased by being supplied with the oil discharged from the outlet portion; a drain mechanism that discharges the oil from specified one control oil chamber among the control oil chambers; an electrical control mechanism that is able to regulate a discharge pressure, which is a hydraulic pressure of the oil discharged from the outlet portion, to a plurality of setting pressures by controlling supply and discharge of the oil discharged from the outlet portion to and from the specified one control oil chamber on the basis of an electric signal and adjusting an internal pressure of the specified one control oil chamber; and a control valve into which a downstream side oil discharged from the outlet portion is introduced as a control pressure, the control valve configured to, when a hydraulic pressure of the introduced oil exceeds a predetermined setting working pressure, adjust the internal pressure of the specified one control oil chamber by supplying the oil discharged from the outlet portion into the specified one control oil chamber or discharging the oil from the specified one control oil chamber.

According to the present invention, it is possible to suppress the increase in the electric power consumption associated with the electrical control mechanism.

EMBODIMENTS FOR CARRYING OUT THE INVENTION

Embodiments of a variable displacement-type oil pump of the present invention will be explained below with reference to the drawings. The followings are embodiments showing that the present invention is applied to a variable displacement-type oil pump that is, for example, an actuating source for a variable valve mechanism that can vary a valve timing of a valve of an internal combustion engine of a vehicle, and supplies lubricating oil to sliding parts of the engine, particularly sliding parts between a piston and a cylinder bore by an oil jet and also supplies lubricating oil to a bearing of a crankshaft.

First Embodiment

Figure 1:
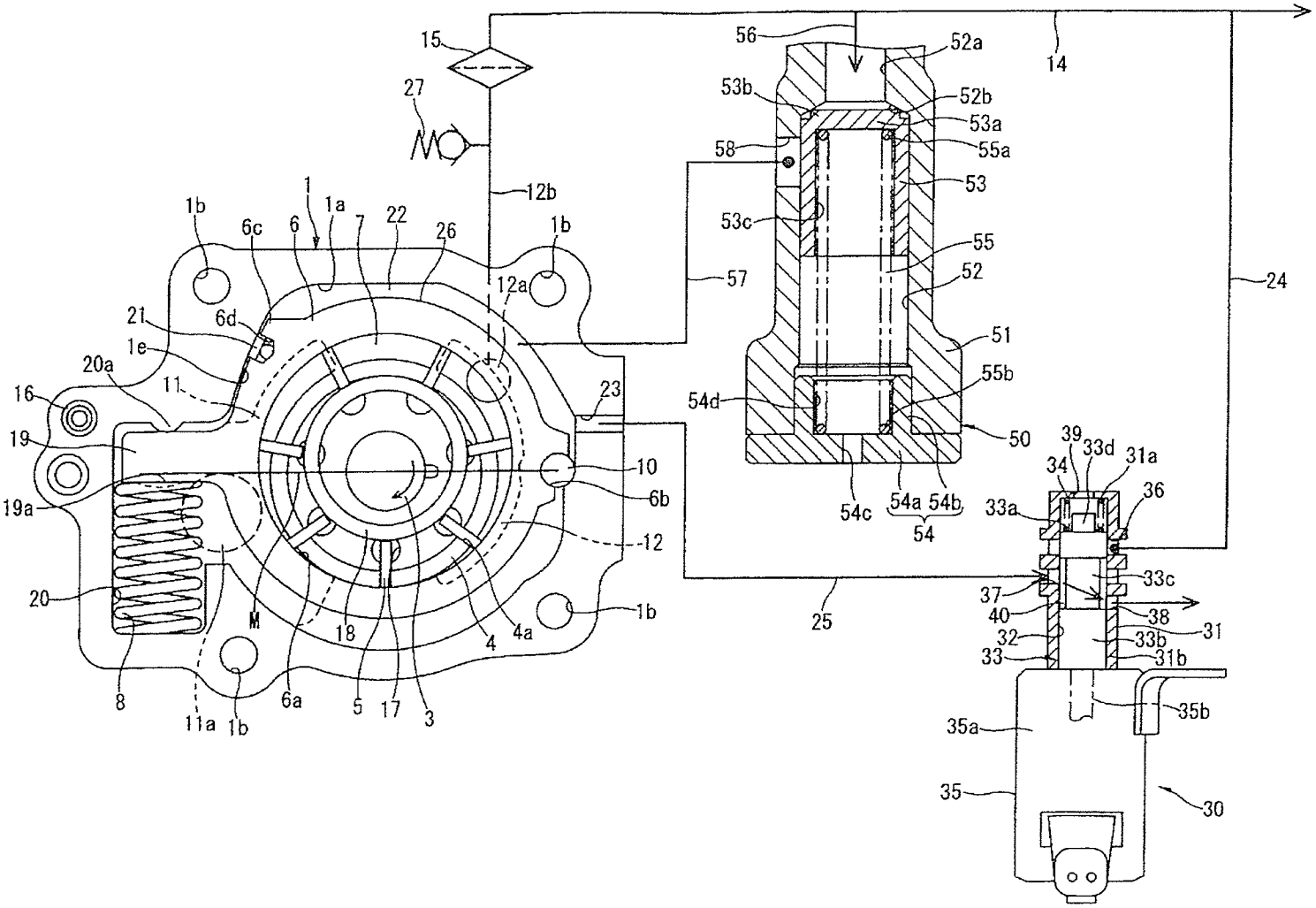
FIG. 1 is a schematic view of a variable displacement-type oil pump according to a first embodiment.
Figure 2:
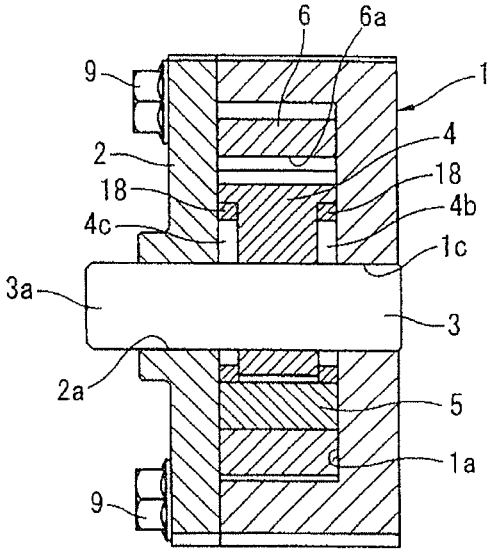
FIG. 2 is a longitudinal cross section of the variable displacement-type oil pump.
Figure 3:
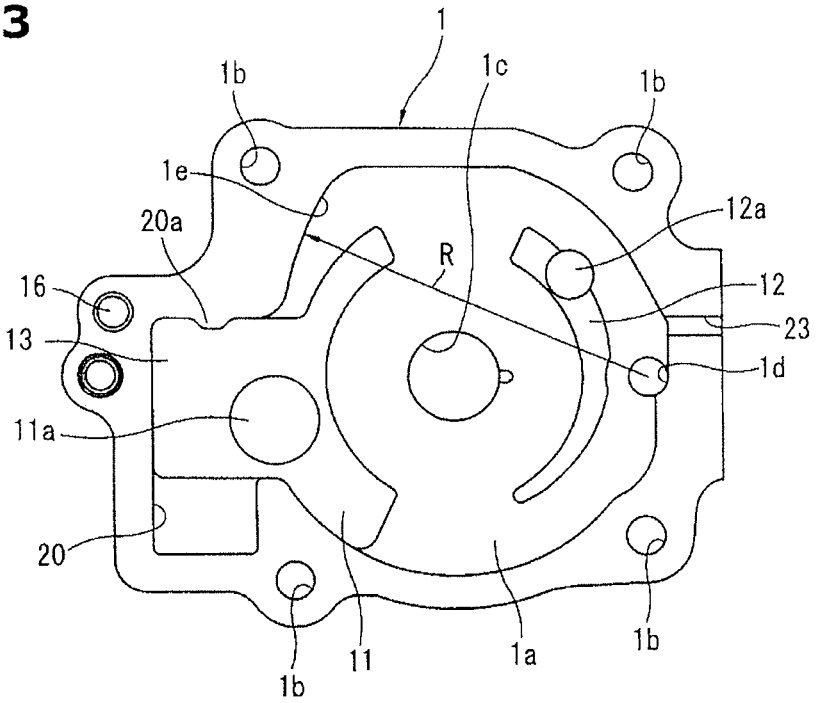
FIG. 3 is a front view of a pump housing of the variable displacement-type oil pump.

A variable displacement-type oil pump of the present embodiment is provided at a front end portion etc. of a cylinder block (not shown) of an internal combustion engine (not shown). As shown in FIGS. 1 to 3, the variable displacement-type oil pump is formed by mainly a bottomed cylindrical-shaped pump housing 1 which is made of aluminum alloy etc., whose one end side is open and which has therein a pump accommodation chamber 1*a*, a pump cover 2 that covers one end opening of the pump housing 1, a drive shaft 3 that is inserted in a substantially middle of the pump housing 1 and driven and rotates by a crankshaft (not shown) of the engine (not shown), a rotor 4 which is rotatably accommodated in the pump accommodation chamber 1*a* and whose middle portion is secured to the drive shaft 3, a plurality of vanes 5 that are accommodated so as to be able to extend/retract in a plurality of slits 4*a* formed at an outer circumferential portion of the rotor 4 by being cut in a radial direction, a cam ring 6 as a movable member which is arranged at an outer circumferential side of the vanes 5 so as to be able to eccentrically rock or swing (or move) with respect to a rotation center of the rotor 4 and defines a plurality of pump chambers 7 in cooperation with the rotor 4 and adjacent two vanes 5 and 5, and a coil spring 8 as a forcing mechanism which is accommodated in the pump housing 1 and always forces the cam ring 6 in a direction in which an eccentric amount is increased. The drive shaft 3, the rotor 4 and the vanes 5 form a pump configuration unit.

As shown in FIG. 2, the pump housing 1 and the pump cover 2 are fixedly connected with four bolts 9 when fixed to the cylinder block. Each bolt 9 is inserted into bolt insertion holes 1*b* (see FIGS. 1 and 3) formed at the pump housing 1 and the pump cover 2, and a top end portion of the bolt 9 is screwed into and secured to a female screw hole (not shown) formed at the cylinder block.

As shown in FIG. 3, a bearing hole 1*c* that rotatably supports one end portion of the drive shaft 3 is formed at a substantially middle position on a bottom surface of the pump accommodation chamber 1*a* of the pump housing 1. Further, a bottomed pin hole 1*d* in which a pivot pin 10 as a pivot of the cam ring 6 is fitted or inserted is formed at a predetermined position on the bottom surface of the pump accommodation chamber 1*a*.

Further, as shown in FIG. 1, the pump housing 1 is provided with a seal sliding contact surface 1*e* at an upper position with respect to a line M (hereinafter, called a "cam ring reference line") formed by connecting an axial center of the pivot pin 10 located at an inner circumferential side of the pump housing 1 and a center of the pump housing 1 (an axial center of the drive shaft 3). As shown in FIG. 3, this seal sliding contact surface 1*e* is formed into an arc surface shape formed with a radius R of a predetermined length being separated from a center of the pin hole 1*d*, and a seal member 21 fitted in an after-mentioned seal groove Gd of the cam ring 6 is always in sliding-contact with the seal sliding contact surface 1*e* within a range in which the cam ring 6 eccentrically rocks.

As shown in FIGS. 1 and 3, on the bottom surface of the pump accommodation chamber 1*a*, a substantially arc-shaped recessed inlet port 11 that is open in an area (an inlet area) where an inside volume of the pump chamber 7 is increased by and according to a pumping operation of the pump configuration unit, and a substantially arc-shaped recessed outlet port 12 that is open in an area (an outlet area) where the inside volume of the pump chamber 7 is decreased by and according to the pumping operation of the pump configuration unit, are formed by being cut and arranged at substantially opposite sides of the bearing hole 1*c*.

As shown in FIG. 3, the inlet port 11 has, at a substantially middle position thereof, an introduction portion 13 that is formed as an integral part of the inlet port 11 so as to extend to an after-mentioned coil spring accommodation chamber 20 side. Further, the inlet port 11 has, at a connecting portion with the introduction portion 13, an inlet hole 11*a* which penetrates a bottom wall of the pump housing 1 and opens to an external portion and whose cross section is substantially circular shape. The inlet port 11 communicates with an oil pan (not shown) through the inlet hole 11*a*. With this structure, oil stored in the oil pan is sucked into each pump chamber 7 in the inlet area by a negative pressure generated according to the pumping operation by the pump configuration unit through the inlet hole 11*a* and the inlet port 11. Here, the inlet port 11 and the inlet hole 11*a* form an inlet portion.

On the other hand, the outlet port 12 has, at an upper position thereof in FIG. 3, an outlet hole 12*a* which penetrates the bottom wall of the pump housing 1 and opens to an external portion and whose cross section is substantially circular shape. The outlet port 12 communicates with a discharge passage 12*b* through the outlet hole 12*a*. As shown in FIG. 1, a downstream end of this discharge passage 12*b* is connected to a main oil gallery 14 of the engine. Here, the outlet port 12 and the outlet hole 12*a* form an outlet portion.

Here, meaning of an upstream side oil discharged from the outlet portion and a downstream side oil discharged from the outlet portion, which are described in claims, will be explained. The upstream side oil discharged from the outlet portion means oil that is discharged from the outlet hole 12*a* and exists (or flows) in the discharge passage 12*b* before an after-mentioned oil filter 15 (before passing through the oil filter 15). In other words, this is oil that has just been discharged from the outlet hole 12*a* and has not yet passed through the oil filter 15. On the other hand, the downstream side oil discharged from the outlet portion means oil that is discharged from the outlet hole 12*a* and exists (or flows) in a passage, which is shown as the main oil gallery 14 in FIG. 1, after passing through the oil filter 15.

With this configuration, oil in each pump chamber 7 in the outlet area, which is pressurized by the pumping operation of the pump configuration unit, is discharged to the main oil gallery 14 through the outlet port 12, the outlet hole 12*a* and the discharge passage 12*b*, then supplied to each sliding part in the engine and a bearing etc. of a variable valve device such as a valve timing control device and a bearing etc. of crankshaft through the main oil gallery 14.

Further, an oil cooler (not shown) to cool the oil flowing in the passage and the oil filter 15 to collect foreign particles in the oil are provided at a connecting portion between the discharge passage 12*b* and the main oil gallery 14.

The oil filter 15 is a filter that filters the oil and collects the foreign particles in the oil by a mesh member (not shown). When filtering the oil, pulsation of the oil (oil flow) is attenuated. Therefore, pulsation of a discharge pressure of the oil flowing in the main oil gallery 14 (hereinafter, called a "main gallery pressure") among the discharge pressure that is a hydraulic pressure of the oil flowing in the outlet portion is attenuated and is stable as compared with that of a hydraulic pressure of the oil immediately after being discharged from the outlet port 12 (simply called a "discharge pressure").

Further, the discharge passage 12*b* is provided with a check ball valve 27 that when the discharge pressure excessively increases, opens and discharges the oil to an external side then decreases the discharge pressure.

As shown in FIG. 2, the pump cover 2 is made of aluminum alloy material, and is formed into a plate shape. The pump cover 2 is provided, at a substantially middle position thereof, with a bearing hole 2*a* that penetrates the pump cover 2 and rotatably supports the other end of the drive shaft 3. A positioning in a circumferential direction of the pump cover 2 with respect to the pump housing 1 is made by a positioning pin 16 (see FIG. 1) that is fixed to the pump housing 1.

In this embodiment, an inner side surface of the pump cover 2 is formed into a substantially flat shape. However, in the same manner as the bottom surface of the pump accommodation chamber 1*a*, the inlet port, the outlet port and a lubricating oil groove could be formed on the inner side surface of the pump cover 2.

A rotation force is transmitted to a top end portion 3*a*, which protrudes from the pump cover 2, of the drive shaft 3 from the crankshaft through a gear etc., then the drive shaft 3 rotates the rotor 4 by this rotation force in an arrow direction (in a clockwise direction) in FIG. 1.

As shown in FIG. 1, the rotor 4 has seven slits 4*a* formed by being cut in a radial direction from an inner center side to a radial direction outer side. Further, a back pressure chamber 17 which has a substantially circular shape in cross section and into which the discharge pressure is introduced from the outlet port 12 is formed at an inner side base end portion of each slit 4*a*.

Each vane 5 is pushed out outwards by centrifugal force generated by rotation of the rotor 4 and a back pressure of the back pressure chamber 17, and a top end surface of each vane 5 is in sliding contact with an inner circumferential surface 6*a* of the cam ring 6. Then, each pump chamber 7 is liquid-tightly defined by opposing inner side surfaces of the adjacent two vanes 5 and 5, the inner circumferential surface 6*a* of the cam ring 6, an outer circumferential surface of the rotor 4, the bottom surface of the pump accommodation chamber 1*a* and the inner side surface of the pump cover 2.

The rotor 4 has a pair of front and rear side ring grooves (recesses) 4*b* and 4*c* on both side surfaces in an axial direction of the rotor 4. And, a pair of ring-shaped vane rings 18 and 18 are accommodated in the respective ring grooves 4*b* and 4*c*. An outer circumferential surface of each vane ring 18 is in sliding contact with an base end edge of each vane 5, and the vane rings 18 and 18 push out each vane 5 to a radial direction outer side by and according to rotation of the vane rings 18 and 18 (rotation of the rotor 4). With this, even when the centrifugal force and/or the back pressure of the back pressure chamber 17 are small, a top end portion of each vane 5 can be in sliding-contact with the inner circumferential surface 6*a* of the cam ring 6, thereby ensuring the liquid-tightness of the pump chamber 7.

The cam ring 6 is formed, as a single-piece component, into a substantially cylindrical shape with sintered metal that is easy to work. As shown in FIG. 1, the cam ring 6 has, at a right side position on the cam ring reference line M on an outer circumferential surface thereof, a pivot hollow portion 6*b* that is fitted to the pivot pin 10 and forms an eccentric rocking fulcrum of the cam ring 6.

Further, an arm 19 that works together with the coil spring 8 is formed integrally with the cam ring 6 at an opposite side position to the pivot hollow portion 6*b* on the outer circumferential surface of the cam ring 6. As shown in FIG. 1, this arm 19 extends toward a radially outer side of the cam ring 6, and an arc-shaped protrusion 19*a* is formed on a lower surface of a top end portion of the arm 19.

At an opposite side position to the pin hole 1*d* of the pump housing 1, the coil spring accommodation chamber 20 that communicates with the pump accommodation chamber 1*a* through the introduction portion 13 is provided. A top end portion of the arm 19 faces an inside of the coil spring accommodation chamber 20, and the coil spring accommodation chamber 20 accommodates therein the coil spring 8.

One end portion of the coil spring 8 elastically contacts the protrusion 19*a* of the arm 19, and the other end portion of the coil spring 8 elastically contacts a bottom surface of the coil spring accommodation chamber 20. Then, the coil spring 8 always forces the cam ring 6 in the direction in which the eccentric amount is increased (hereinafter, called an "eccentric direction"), i.e. in a direction in which a volume variation of each of the plurality of pump chambers 7 is increased, by a spring force of the coil spring 8 through the arm 19. With this configuration, in an operation state shown in FIG. 1, an upper surface of the arm 19 is pressed against a restraining protrusion 20*a* formed on a lower surface of an upper wall of the coil spring accommodation chamber 20 by the spring force of the coil spring 8, and the cam ring 6 is maintained at a position at which the eccentric amount is a maximum.

Further, the cam ring 6 has, at an upper side position with respect to the cam ring reference line M, a substantially triangular-shaped protruding portion 6*c* having a seal surface formed so as to face to the seal sliding contact surface 1*e* of the pump housing 1. This protruding portion 6*c* is provided, on the seal surface thereof, with the seal groove 6*d* formed by being cut along an axial direction of the cam ring 6 and having a substantially arc-shape in cross section. In addition, the seal member 21 that is in sliding-contact with the seal sliding contact surface 1*e* upon eccentric rocking (the eccentric movement) of the cam ring 6 is accommodated in the seal groove 6*d*.

Here, the seal surface of the cam ring 6 is formed into an arc surface shape formed with a predetermined radius, which is slightly smaller than the radius R of a length from the center of the pin hole 1*d* to the seal sliding contact surface 1*e*, being separated from the center of the pin hole 1*d*. Then, the seal surface is in sliding-contact with the seal sliding contact surface 1*e* with a slight clearance provided between them.

The seal member 21 is made of synthetic resin material having low abrasion property, and has a long narrow straight shape. The seal member 21 is disposed in the seal groove 6*d* along the axial direction of the cam ring 6. The seal member 21 is pressed against the seal sliding contact surface 1*e* by an elastic force of an elastic member made of rubber and provided at a bottom of the seal groove 6*d*, and always secures good sealing performance between the seal member 21 and the seal sliding contact surface 1*e*.

One or more control oil chamber for performing an eccentric amount control of the cam ring 6 is provided in an outer circumferential area of the cam ring 6. In the present embodiment, a control oil chamber 22 that is a decrease side control oil chamber is provided at an upper side with respect to the cam ring reference line M in FIG. 1.

This control oil chamber 22 is defined by an inner circumferential surface of the pump housing 1, the outer circumferential surface of the cam ring 6, the pivot pin 10, the seal member 21, the bottom surface of the pump accommodation chamber 1*a* and the inner side surface of the pump cover 2. Further, a communication hole 23 that connects an inside and an outside of the pump housing 1 is formed at a side portion of the pump housing 1 that defines the control oil chamber 22.

As shown in FIG. 1, the control oil chamber 22 is configured so that basically, the oil in the main oil gallery 14 is introduced into the control oil chamber 22 through a branch passage 24 that branches off from the main oil gallery 14, an electromagnetic switching valve 30 as an electrical control mechanism, a connecting passage 25 and the communication hole 23.

Further, the cam ring 6 has, on the outer circumferential surface thereof which defines the control oil chamber 22, a pressure receiving surface 26 having an arc-shaped surface and receiving the hydraulic pressure of the oil. Therefore, the control oil chamber 22 is configured so that when the oil is supplied to an inside of the control oil chamber 22, the hydraulic pressure of this oil acts on the pressure receiving surface 26 and the cam ring 6 is pushed or pressed against the spring force of the coil spring 8 in a direction in which the eccentric amount is decreased (hereinafter, called a "concentric direction"), i.e. in a direction in which the volume variation of each of the plurality of pump chambers 7 is decreased.

Here, a relationship of balance between the spring force of the coil spring 8 and an internal pressure of the control oil chamber 22 is freely changed by changing a set load of the coil spring 8. In the present embodiment, the set load of the coil spring 8 is set such that when the internal pressure of the control oil chamber 22 is equal to or greater than a predetermined setting pressure that is lower than a low pressure P1 that is an engine required pressure (described later), the cam ring 6 works (moves) or is actuated.

The electromagnetic switching valve 30 adjusts the main gallery pressure by controlling the eccentric amount of the cam ring 6 by an electrical control of supply and discharge of the oil to and from the control oil chamber 22. As shown in FIG. 1, the electromagnetic switching valve 30 is formed by mainly a lidded tubular valve body 31 that is press-fitted in a valve accommodation hole formed at the cylinder block (not shown), a spool valve body 33 that is slidably accommodated in a sliding hole 32 formed inside the valve body 31, a valve spring 34 that always forces the spool valve body 33 downward in the drawing, and a solenoid portion 35 that is provided at an opening end of the valve body 31 and properly forces the spool valve body 33 upward in the drawing according to an operating condition etc.

On a peripheral wall of the valve body 31, in an order from an upper end wall 31*a* side to a lower end wall 31*b* side, an introduction port 36 that communicates with the branch passage 24, a connecting port 37 that communicates with the control oil chamber 22 through the connecting passage 25 and the communication hole 23, and a drain port 38 that is a drain mechanism communicating with the atmospheric pressure outside the pump, are each formed along a radial direction. Here, the drain port 38 could not communicate with the atmospheric pressure, but communicate with the inlet port 11.

The valve body 31 is provided, at the upper end wall 31*a* thereof, with an air vent 39 for venting or expelling the back pressure which communicates with the atmospheric pressure and secures good sliding performance of the spool valve body 33.

The spool valve body 33 is formed as a single-piece solid component. The spool valve body 33 has a large diameter cylindrical first land portion 33*a* provided at the upper end wall 31*a* side of the valve body 31, a large diameter cylindrical second land portion 33*b* provided at the lower end wall 31*b* side of the valve body 31, and a cylindrical small diameter shaft portion 33*c* having a relatively small diameter and connecting the both land portions 33*a* and 33*b*.

The first and second land portions 33*a* and 33*b* are formed so as to have a substantially same outside diameter, and are each in sliding contact with an inner peripheral surface of the sliding hole 32 with a slight gap provided.

At an outer peripheral side of the small diameter shaft portion 33*c*, an annular passage 40 is defined by an outer peripheral surface of the small diameter shaft portion 33*c*, opposing inner end surfaces of the first and second land portions 33*a* and 33*b* and the inner peripheral surface of the sliding hole 32. The connecting port 37 always communicates with this annular passage 40 at a maximum opening degree regardless of a movement position of the spool valve body 33, while the introduction port 36 and the drain port 38 properly communicate with the annular passage 40 according to a sliding position of the spool valve body 33.

Further, a cylindrical retaining protrusion 33*d* having a relatively small diameter is provided on an upper end surface of the first land portion 33*a* which faces the upper end wall 31*a* of the valve body 31.

The valve spring 34 is elastically set between a lower surface of the upper end wall 31*a* of the valve body 31 and an outer end surface of the first land portion 33*a*, and always forces the spool valve body 33 to the solenoid portion 35 side. One end portion of the valve spring 34 is retained by an outer peripheral surface of the retaining protrusion 33*d* of the spool valve body 33, and forces the spool valve body 33 stably.

The solenoid portion 35 accommodates, in a casing 35*a* thereof, an electromagnetic coil, a fixed core, a movable core (all not shown) and so on. And, a push-rod 35*b* is connected to a top end portion of the movable core. This push-rod 35*b* is formed into a cylindrical rod shape, and a top end portion of the push-rod 35*b* contacts an outer peripheral surface at the solenoid portion 35 side of the second land portion 33*b*.

When a pulse voltage is applied to the electromagnetic coil of the solenoid portion 35 from an electronic controller (not shown), a thrust according to a voltage value of the pulse voltage acts on the movable core. Then, on the basis of a relative difference between the thrust of the movable core which is transmitted to the spool valve body 33 through the push-rod 35*b* and a spring force of the valve spring 34, the spool valve body 33 moves forward and backward (upward and downward).

The electronic controller is a controller using so-called PWM (pulse width modulation) system. The electronic controller is configured to steplessly control the voltage value of the pulse voltage applied to the electromagnetic coil by modulating a pulse width of the pulse voltage applied to the electromagnetic coil, i.e. by changing a duty ratio.

Further, the electronic controller is configured to detect an engine operating condition from oil temperature and water temperature of the engine, an engine rotation speed and load etc., and especially when the engine is in a low rotation speed state at an engine start etc., interrupt the voltage applied to the electromagnetic coil, while when the engine rotation speed is a predetermined value or more, apply the voltage to the electromagnetic coil in order to adjust or control the main gallery pressure.

With this, the electromagnetic switching valve 30 is configured so that the sliding position of the spool valve body 33 is steplessly or continuously controlled according to the pulse voltage applied to the electromagnetic coil by the electronic controller on the basis of the engine rotation speed etc., and also switching of open and closure of the introduction port 36 and the drain port 38 and enlargement and reduction (increase and decrease) of an opening area of each port when opening the port are performed according to the sliding position of the spool valve body 33.

More specifically, when the pulse voltage applied to the electromagnetic coil of the solenoid portion 35 by the electronic controller is 0, i.e. when application of the voltage is not done (when no energization is made), since the spool valve body 33 is not forced by the push-rod 35*b*, as shown in FIG. 1, the spool valve body 33 is in a state in which the spool valve body 33 is forced to a lowermost side by the spring force of the valve spring 34.

In this case, the introduction port 36 is closed by an outer peripheral surface of the first land portion 33*a*, and the drain port 38 opens to the annular passage 40 with the opening area of the drain port 38 being a maximum.

Figure 4:
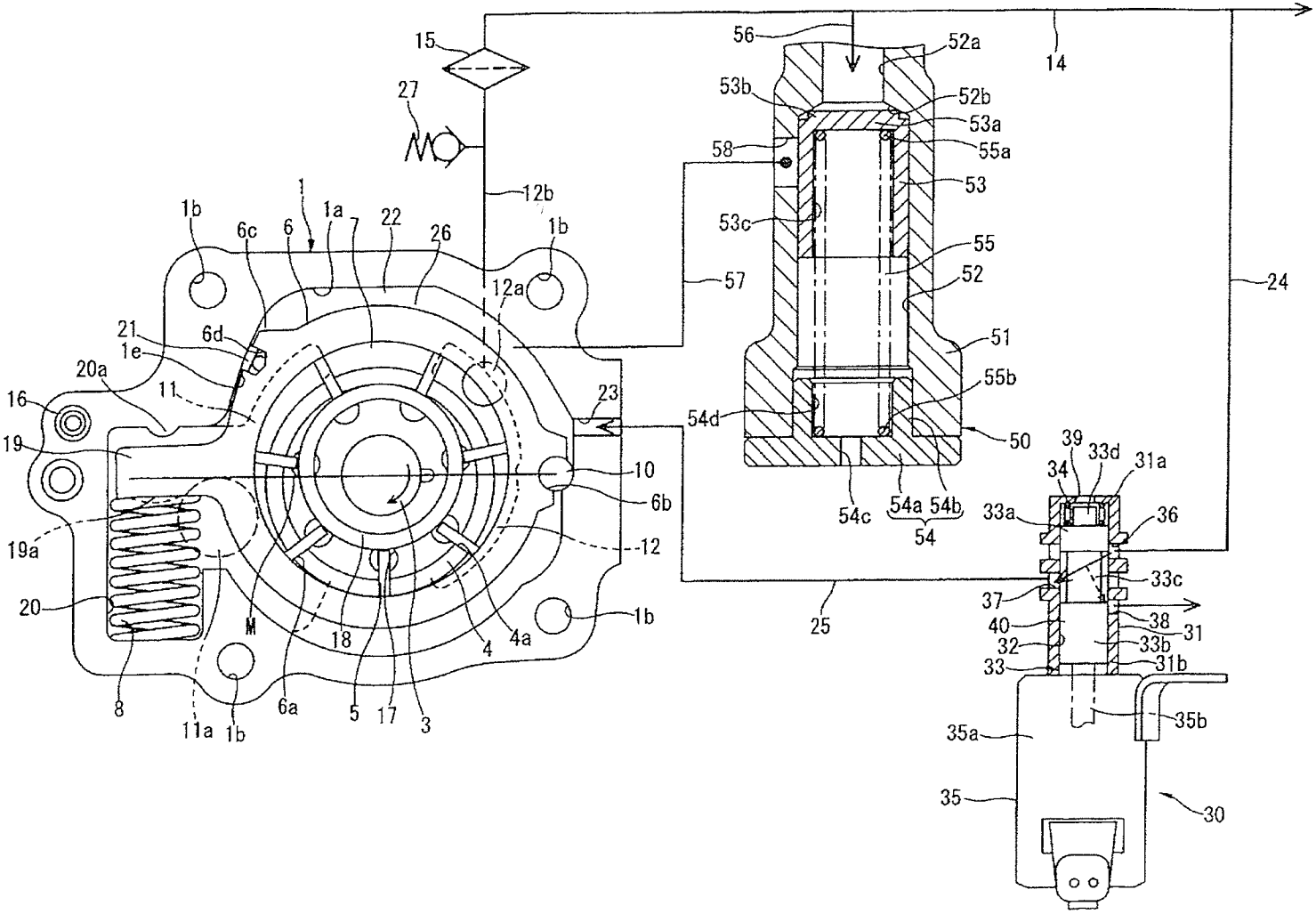
FIG. 4 is a drawing for explaining working of the variable displacement-type oil pump when adjusting a main gallery pressure by an electromagnetic switching valve.

On the other hand, when the pulse voltage is applied to the electromagnetic coil by the electronic controller, as shown in FIG. 4, the spool valve body 33 is pressed by the push-rod 35*b* against the spring force of the valve spring 34 and moves upward in the drawing.

Then, a closure state of the introduction port 36 is cancelled and the introduction port 36 opens to the annular passage 40, while a part of the drain port 38 is closed by an outer peripheral surface of the second land portion 33*b*.

At this time, as the pulse voltage applied to the electromagnetic coil by the electronic controller becomes higher, the opening area of the introduction port 36 more increases. Also, as the pulse voltage applied to the electromagnetic coil by the electronic controller becomes higher, the opening area of the drain port 38 more decreases.

Here, the electronic controller is configured to, during working (or operation) of an after-mentioned control valve 50, maintain a non-energization state in which the pulse voltage is not applied to the electromagnetic coil regardless of the engine rotation speed. With this, the electromagnetic switching valve 30 is configured to, during the working (or the operation) of the control valve 50, maintain a state (an OFF state) in which the spool valve body 33 is forced to the lowermost side by the spring force of the valve spring 34 all the time.

The variable displacement-type oil pump is provided with the control valve 50 that works when the main gallery pressure reaches a high pressure P3 that is a predetermined setting working pressure that is higher than a maximum requiring pressure Pmax which the engine requires, and controls the main gallery pressure instead of the electromagnetic switching valve 30.

As shown in FIG. 1, this control valve 50 is formed by mainly a valve housing 51 arranged at and fixed to an outer side surface of the pump housing 1, an accommodation hole 52 having a circular shape in cross section and provided at the valve housing 51, a pressure sensitive valve body (or a pressure sensing valve body) 53 provided in the accommodation hole 52 so as to be able to slide along an axial direction of the accommodation hole 52, a sealing plug 54 sealing or closing an opening of one end side of the accommodation hole 52, and a control spring 55 elastically set between the sealing plug 54 and the pressure sensing valve body 53.

The accommodation hole 52 is configured to communicate with the main oil gallery 14 through a control hydraulic pressure introduction port 52*a* formed at an upper end wall of the valve housing 51 and having a relatively small diameter and a control hydraulic pressure introduction passage 56, and be supplied with the main gallery pressure from the main oil gallery 14 as a control hydraulic pressure.

Further, a supply port 58 that communicates with the control oil chamber 22 through a communication passage 57 is provided along a radial direction on a peripheral wall at one end side in an axial direction of the accommodation hole 52.

Furthermore, the accommodation hole 52 is provided with a stepped tapered seating surface 52*b* between the control hydraulic pressure introduction port 52*a* and the accommodation hole 52. When after-mentioned pressure receiving portion 53*b* of the pressure sensing valve body 53 is seated on this seating surface 52*b*, communication of the accommodation hole 52 with the control hydraulic pressure introduction port 52*a* is interrupted.

The pressure sensing valve body 53 has a lidded tubular shape by which one end portion at the control hydraulic pressure introduction port 52*a* side of the pressure sensing valve body 53 is closed with an end wall 53*a*, and an outside diameter of the pressure sensing valve body 53 is slightly smaller than an inside diameter of the accommodation hole 52, then slides in the accommodation hole 52 through a slight gap between them.

Further, the pressure sensing valve body 53 is provided, at an outer edge side of the end wall 53*a* thereof, with the protruding cylindrical pressure receiving portion 53*b* whose diameter is slightly smaller than the outside diameter of the pressure sensing valve body 53. A pressure receiving area at a top end surface of this pressure receiving portion 53*b* is formed into a flat shape, and receives the main gallery pressure introduced into the accommodation hole 52 from the control hydraulic pressure introduction port 52*a*.

Moreover, the pressure sensing valve body 53 has therein a control spring accommodation chamber 53*c* that accommodates and retains one end portion 55*a* of the control spring 55.

The sealing plug 54 has a large diameter disk-shaped lid portion 54*a* that closes an opening end of the accommodation hole 52 and a tubular portion 54*b* that has a relatively small diameter and extends from an inner end surface of the lid portion 54*a* along an axial direction.

The lid portion 54*a* is provided, at a substantially middle portion thereof, with an air vent 54*c* for venting or expelling the back pressure which communicates with the atmospheric pressure and secures good sliding performance of the pressure sensing valve body 53.

The tubular portion 54*b* is formed so that an outside diameter of the tubular portion 54*b* is a substantially same as the inside diameter at the opening side of the accommodation hole 52, and the tubular portion 54*b* is press-fitted into the accommodation hole 52. Further, the tubular portion 54*b* has therein a control spring retaining hole 54*d* that accommodates and retains the other end portion 55*b* of the control spring 55.

The control spring 55 is configured so that the one end portion 55*a* elastically contacts an inner end surface of the end wall 53*a*, and the other end portion 55*b* elastically contacts the inner end surface of the lid portion 54*a* of the sealing plug 54, then the control spring 55 always forces the pressure sensing valve body 53 to the control hydraulic pressure introduction port 52*a* side.

Operation of First Embodiment

Operation of the variable displacement-type oil pump according to the first embodiment will be explained below.

First, in a low rotation region after the engine start, since the voltage applied to the electromagnetic coil of the electromagnetic switching valve 30 is interrupted by the electronic controller, as shown in FIG. 1, the spool valve body 33 is not pressed by the push-rod 35*b*, and the spool valve body 33 is in the state in which the spool valve body 33 is forced to the lowermost side by the valve spring 34.

Then, the introduction port 36 is closed by the outer peripheral surface of the first land portion 33*a* of the spool valve body 33 and communication of the introduction port 36 with the connecting port 37 is interrupted, while the drain port 38 communicates with the connecting port 37 with the opening area of the drain port 38 being a maximum.

With this operation, the control oil chamber 22 communicates with the drain port 38 through the communication hole 23, the connecting passage 25, the connecting port 37 and the annular passage 40, and opens to an external side. The control oil chamber 22 then becomes in a state in which the hydraulic pressure does not work nor function at all.

As a consequence, the cam ring 6 rotates in the clockwise direction in FIG. 1 by the spring force of the coil spring 8, and is maintained in a state in which the upper surface of the arm 19 is pressed against or contacts the restraining protrusion 20*a*, i.e. a maximum eccentric state in which the eccentric amount is a maximum.

Figure 6:
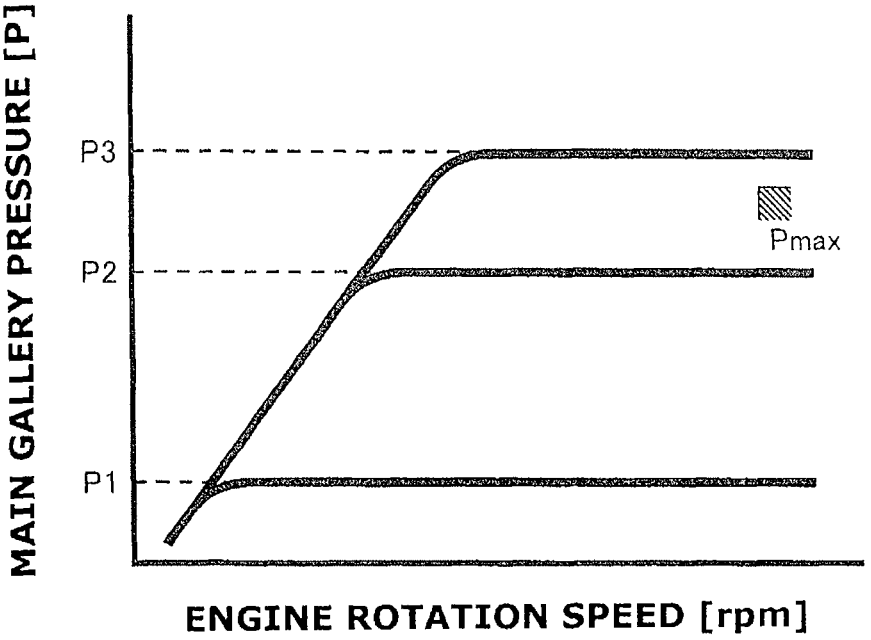
FIG. 6 is a drawing showing an engine rotation speed-main main gallery pressure characteristic of the variable displacement-type oil pump of the present embodiment.

Therefore, as shown in FIG. 6, the main gallery pressure of the variable displacement-type oil pump in the OFF state of the electromagnetic switching valve 30 increases substantially in proportion to increase in the engine rotation speed.

When the main gallery pressure increases to a predetermined value or more from this state, the electromagnetic switching valve 30 works or is actuated, and the main gallery pressure is controlled according to the engine required pressure.

For instance, in a case where the hydraulic pressure is supplied to the valve timing control device from the main oil gallery 14, when the main gallery pressure reaches the predetermined low pressure P1 that is slightly higher than a required pressure of the valve timing control device, energization of the electromagnetic coil of the electromagnetic switching valve 30 from the electronic controller (application of the voltage to the electromagnetic coil of the electromagnetic switching valve 30 by the electronic controller) is started. Then, as shown in FIG. 4, the spool valve body 33 is pressed by the push-rod 35*b*, and moves upward in the drawing against the spring force of the valve spring 34.

Then, a closure state of the introduction port 36 by the first land portion 33*a* is partly cancelled, and the introduction port 36 communicates with the connecting port 37 with the opening area of the introduction port 36 narrowed. On the other hand, the drain port 38 communicates with the connecting port 37 with the opening area of the drain port 38 being smaller than that of the introduction port 36 by the outer peripheral surface of the second land portion 33*b*.

With this operation, since an amount of the oil introduced into the annular passage 40 from the introduction port 36 exceeds an amount of the oil discharged from the annular passage 40 through the drain port 38, a part of the oil introduced from the introduction port 36 is supplied to the control oil chamber 22 through the connecting port 37, the connecting passage 25 and the communication hole 23.

Subsequently, the hydraulic pressure of the oil supplied into the control oil chamber 22 acts on the receiving surface 26 of the cam ring 6, and the cam ring 6 is forced against the spring force of the coil spring 8 in the concentric direction, thereby preventing the main gallery pressure from becoming the low pressure P1 or more.

On the other hand, when the main gallery pressure is lower than the low pressure P1 by decrease in the eccentric amount of the cam ring 6, the pulse voltage applied to the electromagnetic coil is slightly decreased by the electronic controller, and the spool valve body 33 slightly moves downward in the drawing from a state of FIG. 4.

Then, the opening area of the introduction port 36 is decreased, while the opening area of the drain port 38 is increased. An amount of the oil supplied into the control oil chamber 22 is therefore reduced.

With this operation, since the hydraulic pressure of the control oil chamber 22 is decreased and the eccentric amount of the cam ring 6 is increased according to this pressure decrease of the control oil chamber 22, the main gallery pressure is increased again.

As described above, by controlling (increasing and decreasing) the opening areas of the introduction port 36 and the drain port 38 according to the sliding movement of the spool valve body 33, the variable displacement-type oil pump properly controls or adjusts (increases and decreases) the internal pressure of the control oil chamber 22, and controls or adjusts (regulates) the main gallery pressure to the low pressure P1 as shown in FIG. 6.

Here, when controlling the main gallery pressure to the low pressure P1, the hydraulic pressure that is slightly decreased with respect to the low pressure P1 due to passage pressure loss etc. is supplied into the control oil chamber 22. However, as described above, since the set load of the coil spring 8 is previously set such that when the internal pressure of the control oil chamber 22 is equal to or greater than the predetermined setting pressure that is lower than the low pressure P1, the cam ring 6 works (moves) or is actuated, pressure control by the cam ring 6 can be performed without being affected by the passage pressure loss etc.

Further, for instance, in a case where the hydraulic pressure is supplied to the oil jet from the main oil gallery 14, when the main gallery pressure reaches a predetermined middle pressure P2 that is slightly higher than a required pressure of the oil jet, energization of the electromagnetic coil of the electromagnetic switching valve 30 from the electronic controller (application of the voltage to the electromagnetic coil of the electromagnetic switching valve 30 by the electronic controller) is started. After that, the main gallery pressure is controlled by the electromagnetic switching valve 30 so that the main gallery pressure is maintained to the middle pressure P2. This control manner and operation are the same as those of control of the main gallery pressure to the low pressure P1.

As explained above, according to the present embodiment, by properly controlling the pulse voltage applied to the electromagnetic coil of the electromagnetic switching valve 30 by the electronic controller, it is possible to stably control the main gallery pressure to a plurality of arbitrary setting pressures such as the low pressure P1 and the middle pressure P2.

In the present embodiment, in a case where the hydraulic pressure is supplied to the bearing portion of the crankshaft which requires a highest hydraulic pressure in the engine from the main oil gallery 14, by bringing the electromagnetic switching valve 30 into the OFF state and operating (or controlling) the control valve 50, the main gallery pressure is controlled.

That is, in the case where the hydraulic pressure is supplied to the bearing portion of the crankshaft, the main gallery pressure is controlled to the predetermined high pressure P3 that is slightly higher than the maximum requiring pressure Pmax that is a required pressure of the bearing portion. In this case, the voltage is not applied to the electromagnetic coil of the electromagnetic switching valve 30 by the electronic controller, and the electromagnetic switching valve 30 is maintained in the OFF state in which the spool valve body 33 is forced to the lowermost side in FIG. 1 by the valve spring 34.

Then, although the main gallery pressure increases substantially in proportion to increase in the engine rotation speed by the OFF state of the electromagnetic switching valve 30, in the present embodiment, when this main gallery pressure reaches the high pressure P3, the control valve 50 works or is actuated, then the control of the main gallery pressure is carried out.

More specifically, when the engine rotation speed is low and the main gallery pressure acting on the pressure receiving portion 53*b* is small, as shown in FIGS. 1 and 4, the control valve 50 is maintained in a state in which a top end edge of the pressure receiving portion 53*b* is seated on the stepped tapered seating surface 52*b* by a spring force of the control spring 55. However, when the main gallery pressure reaches the high pressure P3 by the increase in the engine rotation speed, as shown in FIG. 5, the pressure receiving portion 53*b* receives the high pressure P3, and the pressure sensing valve body 53 moves to the sealing plug 54 side against the spring force of the control spring 55.

Then, since the control hydraulic pressure introduction port 52*a* communicates with the supply port 58, the oil flowing in the main oil gallery 14 is supplied into the control oil chamber 22 through the control hydraulic pressure introduction passage 56, the control hydraulic pressure introduction port 52*a*, the accommodation hole 52, the supply port 58 and the communication passage 57.

At this time, even though a part of the oil supplied into the control oil chamber 22 is discharged to the external side from the drain port 38 through the communication hole 23 and the connecting passage 25, since most of the oil is stored in the control oil chamber 22, the internal pressure of the control oil chamber 22 is increased. And, as shown in FIG. 5, the cam ring 6 moves in the concentric direction against the spring force of the coil spring 8 by this increase of the internal pressure of the control oil chamber 22, thereby preventing the main gallery pressure from becoming the high pressure P3 or more.

Figure 5:
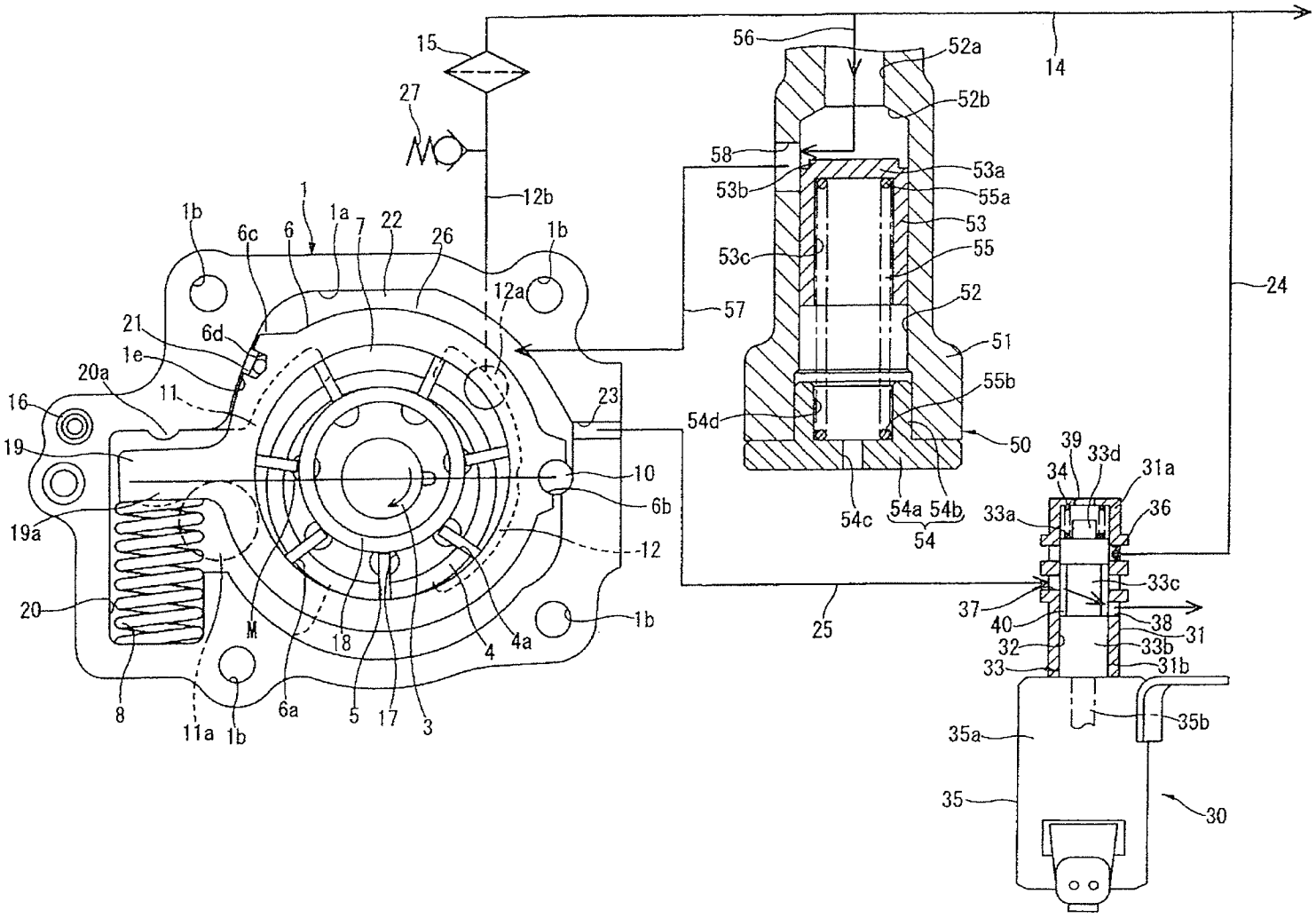
FIG. 5 is a drawing for explaining working of the variable displacement-type oil pump when adjusting the main gallery pressure by a control valve.

On the other hand, when the main gallery pressure is lower than the high pressure P3 by decrease in the eccentric amount of the cam ring 6, since a force acting on the pressure receiving portion 53*b* also becomes small, the pressure sensing valve body 53 is pressed by the control spring 55 and slightly moves upward from a state of FIG. 5.

Then, while an amount of the oil discharged from the drain port 38 is unchanged, an amount of the oil supplied into the control oil chamber 22 from the main oil gallery 14 according to decrease in an opening area of the supply port 58 is decreased. Therefore, the oil stored in the control oil chamber 22 is decreased. Further, since the hydraulic pressure of the control oil chamber 22 is decrease by this decrease in the oil amount of the control oil chamber 22, the eccentric amount of the cam ring 6 is increased, and the main gallery pressure is increased again.

As explained above, according to the present embodiment, by controlling (increasing and decreasing) the opening area of the supply port 58 by a slight sliding movement of the pressure sensing valve body 53 according to the variation of the main gallery pressure in a working state (an operating state) of the control valve 50 without requiring operation or working of the electromagnetic switching valve 30, the internal pressure of the control oil chamber 22 is properly controlled or adjusted (increased and decreased), then, as shown in FIG. 6, the main gallery pressure can be controlled or adjusted to the high pressure P3.

With this, since electric power consumption of the electromagnetic switching valve 30 becomes 0 when controlling the main gallery pressure to the high pressure P3, electric power consumption associated with the electromagnetic switching valve 30 can be reduced.

Further, in the present embodiment, as a control hydraulic pressure of the control valve 50, the main gallery pressure that is a relatively stable hydraulic pressure located at a downstream side with respect to the oil filter 15 is used. Therefore, an influence of the pulsation of the oil on the pressure sensing valve body 53 is hard to occur. With this, since wobble or vibration of the pressure sensing valve body 53 is suppressed, the main gallery pressure can be stably adjusted to the high pressure P3.

Second Embodiment

Figure 7:
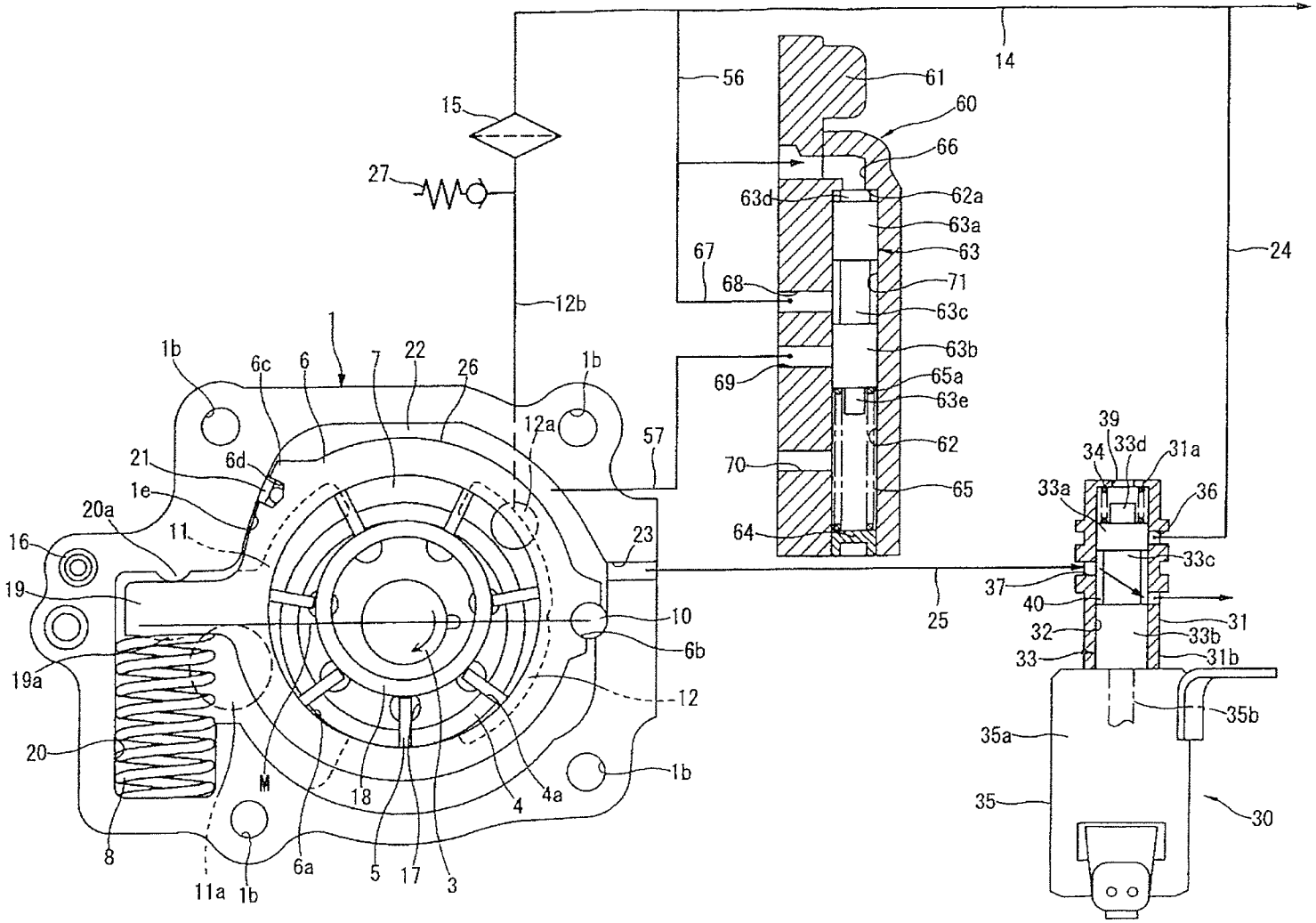
FIG. 7 is a schematic view of the variable displacement-type oil pump according to a second embodiment.
Figure 8:
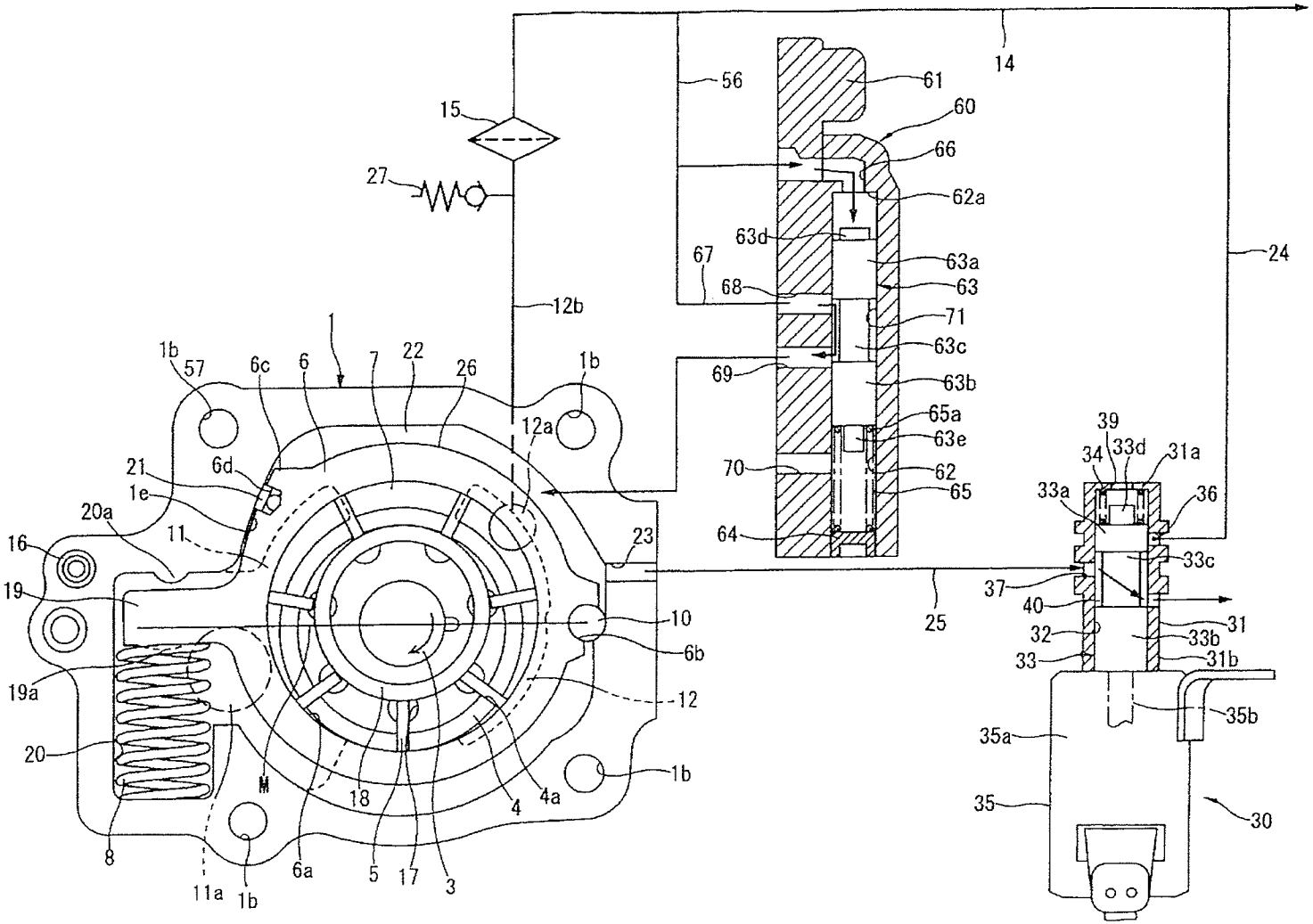
FIG. 8 is a drawing for explaining working of the variable displacement-type oil pump when adjusting the main gallery pressure by a pilot valve.

FIGS. 7 and 8 illustrate a second embodiment of the present invention. A basic structure or configuration of the second embodiment is the same as that of the first embodiment. However, in the second embodiment, the control valve 50 of the first embodiment is changed to a pilot valve 60 that is a control valve.

That is, as shown in FIG. 7, the pilot valve 60 is formed by mainly a valve housing 61 arranged at and fixed to the outer side surface of the pump housing 1, an accommodation hole 62 having a circular shape in cross section and provided at the valve housing 61, a spool valve body 63 provided in the accommodation hole 62 so as to be able to slide along an axial direction of the accommodation hole 62, a bowl-shaped plug 64 press-fitted into an opening at one end side of the accommodation hole 62, and a control spring 65 elastically set between the plug 64 and the spool valve body 63.

The valve housing 61 has, at a wall portion at an axial direction upper end side of the accommodation hole 62, a pilot pressure introduction port 66 whose diameter is smaller than that of the accommodation hole 62. This pilot pressure introduction port 66 communicates with the main oil gallery 14 through the control hydraulic pressure introduction passage 56, and the main gallery pressure as a pilot pressure is introduced into the accommodation hole 62 from the main oil gallery 14.

On a peripheral wall of the accommodation hole 62, in an order from the pilot pressure introduction port 66 side to the plug 64 side, an introduction port 68 that is connected to the main oil gallery 14 through a main gallery pressure introduction passage 67 that branches off from the control hydraulic pressure introduction passage 56, a communication port 69 that communicates with the control oil chamber 22 through the communication passage 57, and an air vent 70 for securing good sliding performance of the spool valve body 63, are each formed along a radial direction.

Further, in the accommodation hole 62, a flat seating surface 62*a* is provided at a lower portion of the upper wall where the pilot pressure introduction port 66 is formed. When an after-mentioned pressure receiving portion 63*d* of the spool valve body 63 is seated on this seating surface 62*a*, communication of the accommodation hole 62 with the pilot pressure introduction port 66 is interrupted.

The spool valve body 63 has a large diameter cylindrical first land portion 63*a* provided at the pilot pressure introduction port 66 side, a large diameter cylindrical second land portion 63*b* provided at the plug 64 side, and a cylindrical small diameter shaft portion 63*c* having a relatively small diameter and connecting the both land portions 63*a* and 63*b*.

The first and second land portions 63*a* and 63*b* are formed so as to have a substantially same outside diameter, and are each in sliding contact with an inner peripheral surface of the accommodation hole 62 with a slight gap provided.

At an outer peripheral side of the small diameter shaft portion 63*c*, an annular passage 71 where the oil flows is defined by an outer peripheral surface of the small diameter shaft portion 63*c*, the inner peripheral surface of the accommodation hole 62 and opposing inner end surfaces of the first and second land portions 63*a* and 63*b*. The introduction port 68 always communicates with this annular passage 71 at a maximum opening degree regardless of a sliding position of the spool valve body 63, while the communication port 69 properly communicates with the annular passage 71 according to the sliding position of the spool valve body 63.

Further, the protruding cylindrical pressure receiving portion 63*d* having a relatively small diameter is provided at an end surface at the pilot pressure introduction port 66 side of the first land portion 63*a*. A pressure receiving area at a top end surface of this pressure receiving portion 63*d* is formed into a flat shape, and receives the pilot pressure supplied to the pilot pressure introduction port 66 from the main oil gallery 14.

Furthermore, a small diameter cylindrical protrusion 63*e* that retains one end portion 65*a* of the control spring 65 is provided on an end surface at the plug 64 side of the second land portion 63*b*.

Operation of Second Embodiment

Also in the present embodiment, in the same manner as the first embodiment, it is possible to control the main gallery pressure to an arbitrary setting pressure by the working or operation of the pilot valve 60.

Further, in the present embodiment, when controlling the main gallery pressure to the high pressure P3, by bringing the electromagnetic switching valve 30 into the OFF state and operating (or controlling) the pilot valve 60, the control of the main gallery pressure is carried out.

More specifically, when the engine rotation speed is low and the main gallery pressure (the pilot pressure) acting on the pressure receiving portion 63*d* of the spool valve body 63 is small, the pilot valve 60 is maintained in a state in which a top end edge of the pressure receiving portion 63*d* is seated on the seating surface 62*a* by a spring force of the control spring 65. However, when the main gallery pressure that increases substantially in proportion to increase in the engine rotation speed by the OFF state of the electromagnetic switching valve 30 reaches the high pressure P3, as shown in FIG. 8, the pressure receiving portion 63*d* receives the main gallery pressure, and the spool valve body 63 moves to the plug 64 side against the spring force of the control spring 65.

Then, since the introduction port 68 and the communication port 69 communicate with each other, the oil flowing in the main oil gallery 14 is supplied into the control oil chamber 22 through the control hydraulic pressure introduction passage 56, the main gallery pressure introduction passage 67, the introduction port 68, the annular passage 71, the communication port 69 and the communication passage 57.

At this time, even though a part of the oil supplied into the control oil chamber 22 is discharged to the external side from the drain port 38 through the communication hole 23 and the connecting passage 25, since most of the oil is stored in the control oil chamber 22, the internal pressure of the control oil chamber 22 is increased. And, as shown in FIG. 8, the cam ring 6 moves in the concentric direction against the spring force of the coil spring 8 by this increase of the internal pressure of the control oil chamber 22, thereby preventing the main gallery pressure from becoming the high pressure P3 or more.

On the other hand, when the main gallery pressure is lower than the high pressure P3 by decrease in the eccentric amount of the cam ring 6, since a force acting on the pressure receiving portion 63*d* also becomes small, the spool valve body 63 is pressed by the control spring 65 and slightly moves upward from a state of FIG. 8.

Then, while an amount of the oil discharged from the drain port 38 is unchanged, an amount of the oil supplied into the control oil chamber 22 from the main oil gallery 14 according to decrease in an opening area of the communication port 69 is decreased. Therefore, the oil stored in the control oil chamber 22 is decreased. Further, since the hydraulic pressure of the control oil chamber 22 is decrease by this decrease in the oil amount of the control oil chamber 22, the eccentric amount of the cam ring 6 is increased, and the main gallery pressure is increased again.

As explained above, also according to the present embodiment, in the same manner as the first embodiment, by controlling (increasing and decreasing) the opening area of the communication port 69 by a slight sliding movement of the spool valve body 63 according to the variation of the main gallery pressure without actuating the electromagnetic switching valve 30, the internal pressure of the control oil chamber 22 is properly controlled or adjusted (increased and decreased), then, as shown in FIG. 6, the main gallery pressure can be controlled or adjusted to the high pressure P3.

With this, since electric power consumption of the electromagnetic switching valve 30 becomes 0 when controlling the main gallery pressure to the high pressure P3, electric power consumption associated with the electromagnetic switching valve 30 can be reduced. Further, in the present embodiment, as a control hydraulic pressure of the pilot valve 60, the main gallery pressure is used. Therefore, since wobble or vibration of the spool valve body 63 is suppressed, the main gallery pressure can be stably adjusted to the high pressure P3.

Third Embodiment

Figure 9:
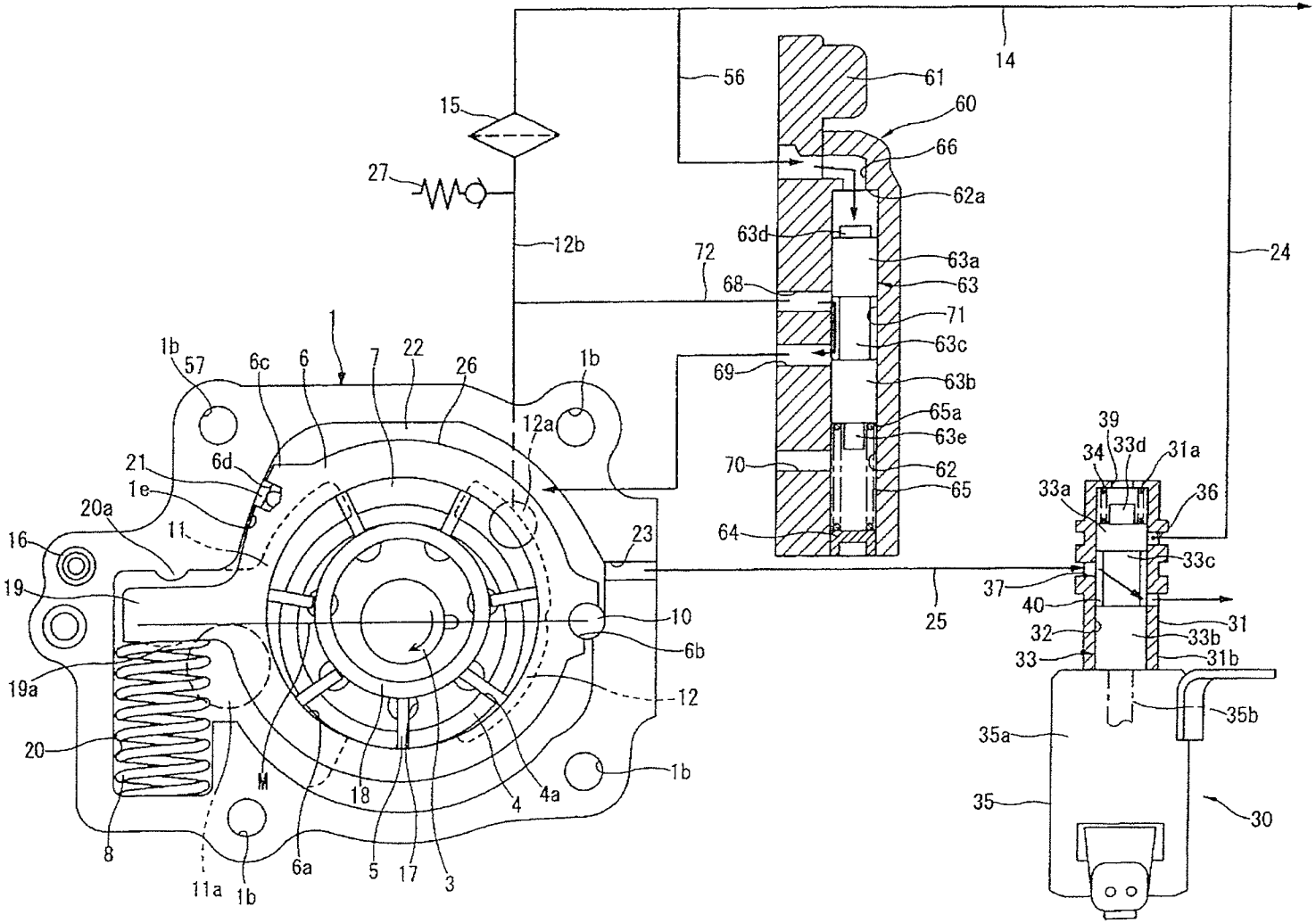
FIG. 9 is a schematic view of the variable displacement-type oil pump according to a third embodiment.

FIG. 9 illustrates a third embodiment of the present invention. A basic structure or configuration of the third embodiment is the same as that of the second embodiment. However, in the third embodiment, the main gallery pressure introduction passage 67 is removed. Instead, a discharge pressure introduction passage 72 whose one end is connected to the discharge passage 12*b* and whose other end is connected to the introduction port 68 is provided.

With this configuration, in the present embodiment, when controlling or adjusting the main gallery pressure by the pilot valve 60, although a relatively unstable discharge pressure having pulsation is supplied to the control oil chamber 22, since a position control itself of the spool valve body 63 is performed by the main gallery pressure in the same manner as the second embodiment, a stable control can be carried out.

Therefore, according to the present embodiment, even though an oil supply passage to the control oil chamber 22 through the pilot valve 60 is changed, it is possible to obtain the same working and effect as those of the second embodiment.

Fourth Embodiment

Figure 10:
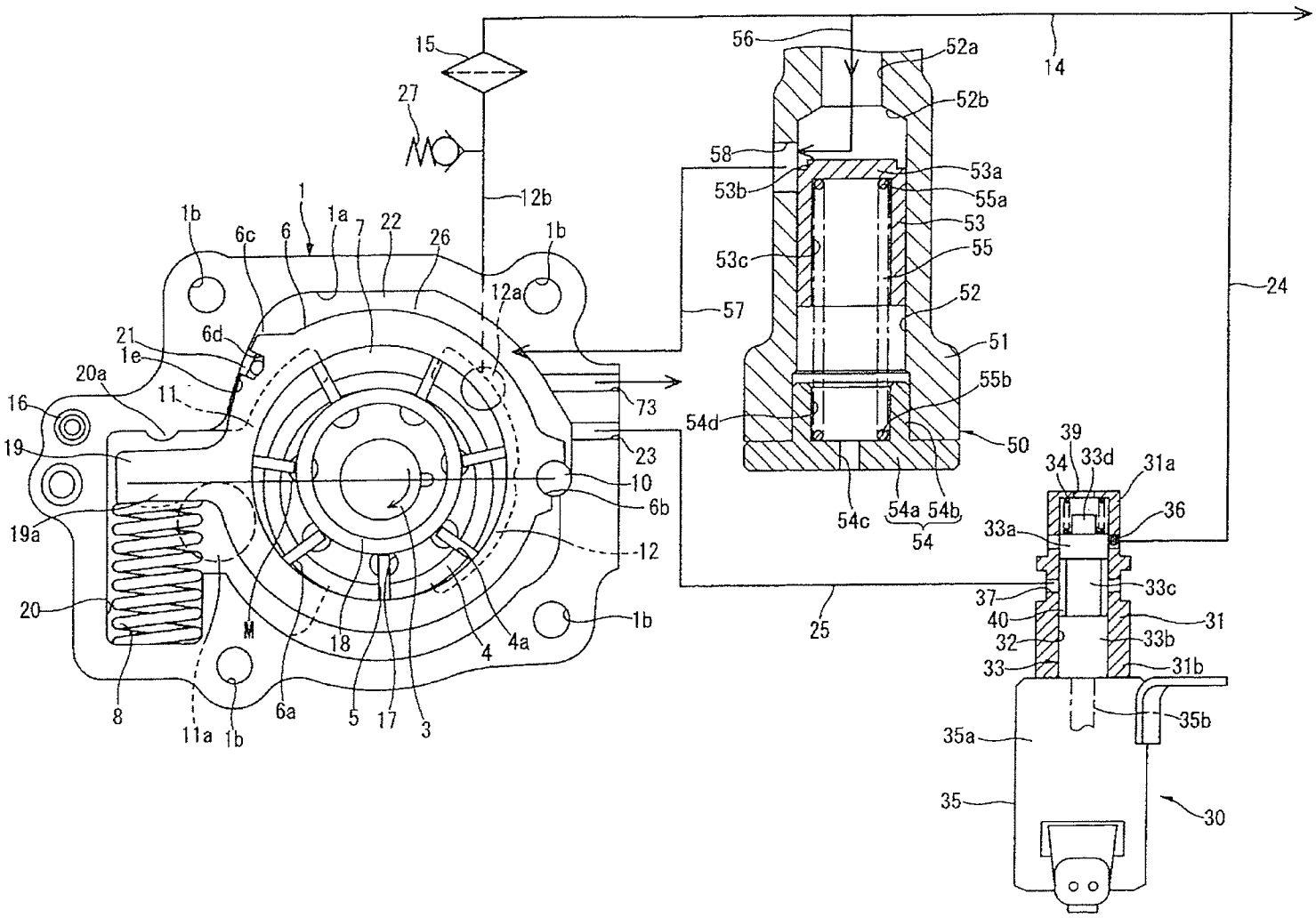
FIG. 10 is a schematic view of the variable displacement-type oil pump according to a fourth embodiment.

FIG. 10 illustrates a fourth embodiment of the present invention. A basic structure or configuration of the fourth embodiment is the same as that of the first embodiment. However, in the fourth embodiment, a forming position of a drain port for discharging the oil of the control oil chamber 22 is changed.

That is, in the present embodiment, the drain port 38 of the valve body 31 of the electromagnetic switching valve 30 is removed, and the electromagnetic switching valve 30 has only the two ports of the introduction port 36 and the connecting port 37.

Then, in the present embodiment, instead of the removed drain port 38, a drain port 73 as a drain mechanism that discharges the oil of the control oil chamber 22 is provided at the pump housing 1. This drain port 73 is formed at and penetrate a peripheral wall of the pump housing 1 forming the control oil chamber 22, and connects the control oil chamber 22 and the atmospheric pressure at a pump external side. Here, the drain port 73 could be configured to not connect the control oil chamber 22 and the atmospheric pressure at a pump external side, but connect the control oil chamber 22 and the inlet port 11.

Accordingly, in the present embodiment, the oil supplied into the control oil chamber 22 through the electromagnetic switching valve 30 and the control valve 50 is discharged to the pump external side through the drain port 73.

Therefore, although an amount of the oil discharged from the control oil chamber 22 and a rate of change of the oil discharge amount according to change of the engine rotation speed are different from those of the first embodiment, by previously setting a supply amount of the oil supplied to the control oil chamber 22 through the electromagnetic switching valve 30 and the control valve 50 with consideration given to these differences, it is possible to perform the same pressure control as that of the first embodiment.

Thus, according to the present embodiment, even when the drain port 73 is provided at the pump housing 1, since the same hydraulic pressure characteristics and working and effect as those of the first embodiment can be obtained, flexibility of layout when installing the variable displacement-type oil pump of the present invention in a vehicle can be increased.

Fifth Embodiment

Figure 11:
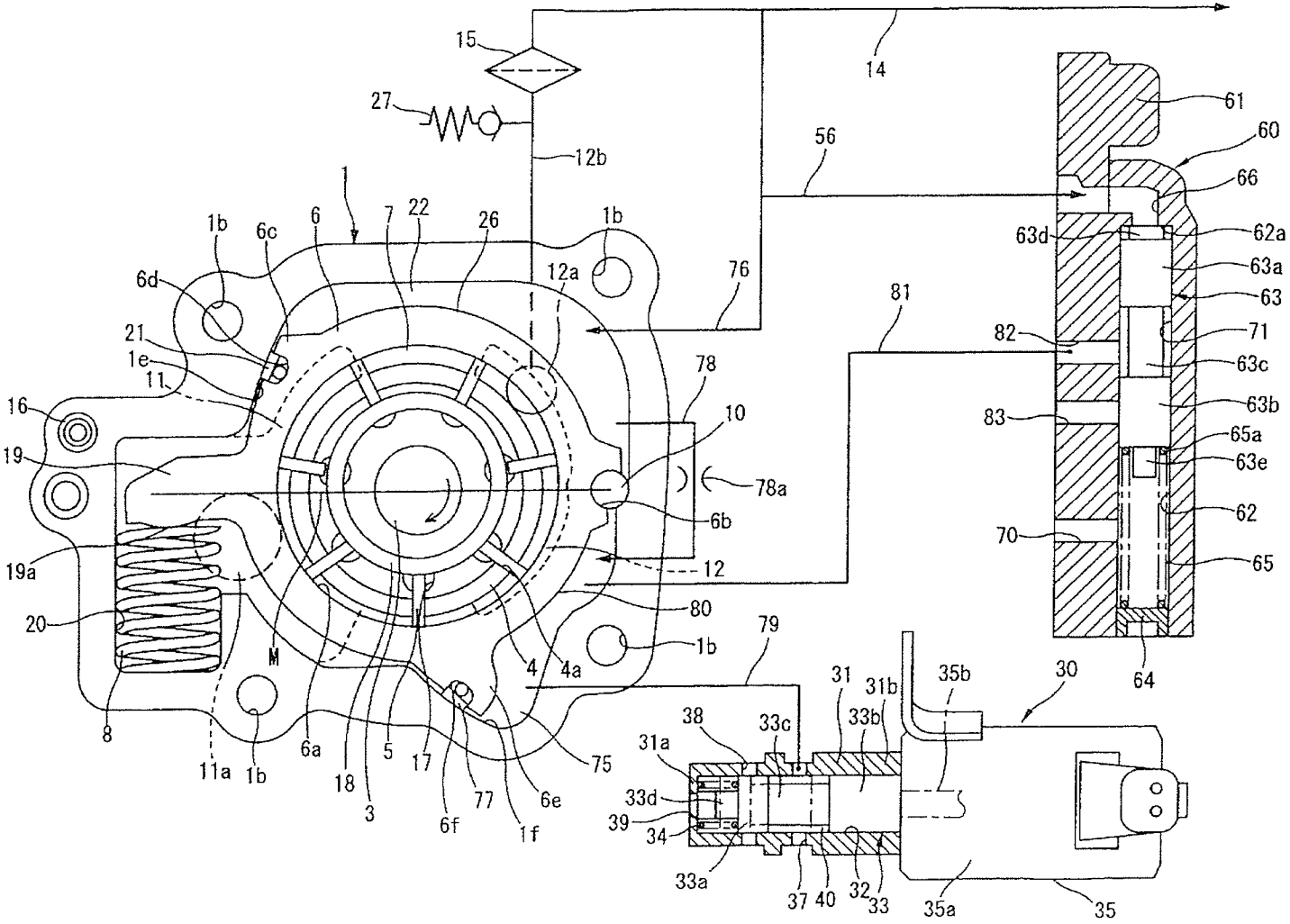
FIG. 11 is a drawing for explaining working of the variable displacement-type oil pump when adjusting the main gallery pressure by an electromagnetic switching valve according to a fifth embodiment.
Figure 12:
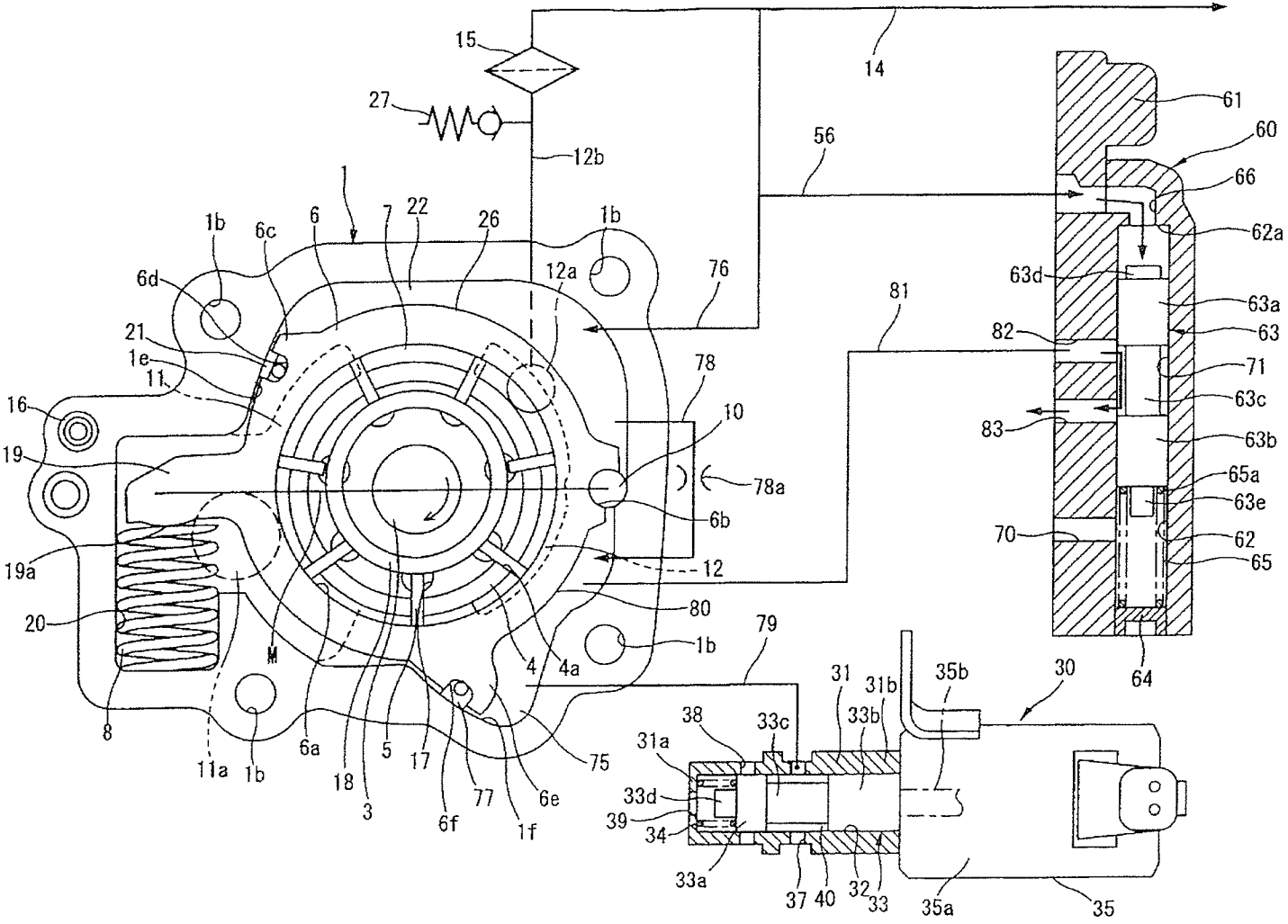
FIG. 12 is a drawing for explaining working of the variable displacement-type oil pump when adjusting the main gallery pressure by a pilot valve.

FIGS. 11 and 12 illustrate a fifth embodiment of the present invention. Since a basic structure or configuration of the fifth embodiment is the same as that of the first embodiment, the same element or component as that of the first embodiment is denoted by the same reference sign, and its explanation will be omitted.

In the present embodiment, a second control oil chamber 75 as an increase side control oil chamber is formed at a lower side with respect to the pivot pin 10 in the pump housing 1. That is, the first control oil chamber 22 and the second control oil chamber 75 are provided at upper and lower positions of the cam ring reference line M (the pivot pin 10) in the pump housing 1.

The first control oil chamber 22 is configured so that the main gallery pressure is supplied into the first control oil chamber 22 through a first control oil chamber communication passage 76 that branches off from the control hydraulic pressure introduction passage 56.

When forming the second control oil chamber 75, an arc-shaped second seal sliding contact surface if is formed at a substantially opposite side to the seal sliding contact surface 1*e* which is substantially symmetrical with respect to the cam ring reference line M on the inner circumferential surface of the pump housing 1.

Further, a second protruding portion 6*e* is formed at a position, which corresponds to the second seal sliding contact surface if, of the cam ring 6. In addition, a second seal groove 6*f* formed by being cut along the axial direction of the cam ring 6 and having a substantially arc-shape in cross section is provided on an outer surface of the second protruding portion 6*e*. Furthermore, a second seal member 77 which is made of synthetic resin material having low abrasion property and has a long narrow straight shape and which is in sliding contact with the second seal sliding contact surface if upon eccentric rocking (the eccentric movement) of the cam ring 6 is accommodated in the second seal groove 6*f*.

The second control oil chamber 75 is defined by the inner circumferential surface of the pump housing 1, the outer circumferential surface of the cam ring 6, the pivot pin 10, the second seal member 77, the bottom surface of the pump accommodation chamber 1*a* and the inner side surface of the pump cover 2. The second control oil chamber 75 communicates with the first control oil chamber 22 through a second control oil chamber communication passage 78 having an orifice 78*a*. With this structure, the second control oil chamber 75 is supplied with a hydraulic pressure, which is slightly decreased with respect to the internal pressure of the control oil chamber 22 through the orifice 78*a*, from the first control oil chamber 22 through the second control oil chamber communication passage 78.

The second control oil chamber 75 communicates with the connecting port 37 of the electromagnetic switching valve 30 through a discharge passage 79.

Further, a second pressure receiving surface 80 having an arc-shaped surface and receiving the hydraulic pressure of the oil is formed on the outer circumferential surface of the cam ring 6 which defines the second control oil chamber 75. Therefore, the second control oil chamber 75 is configured so that when the oil is supplied to an inside of the second control oil chamber 75, the hydraulic pressure of this oil acts on the second pressure receiving surface 80 and the cam ring 6 is pushed or pressed in the eccentric direction, i.e. in a direction in which the volume variation of each of the plurality of pump chambers 7 is increased.

In the present embodiment, the restraining protrusion 20*a* is removed from the lower surface of the upper wall of the coil spring accommodation chamber 20. Therefore, when the cam ring 6 is in the maximum eccentric state, the upper surface of the arm 19 directly contacts the lower surface of the upper wall of the coil spring accommodation chamber 20.

A basic structure or configuration of the electromagnetic switching valve 30 in the present embodiment is the same as that of the second embodiment. However, as changing points, one port located on the air vent 39 side of two ports formed at right and left sides of the valve body 31 in FIG. 11 has a function as the drain port 38 that is a drain mechanism, and the other port located on the solenoid portion 35 side has a function as the connecting port 37.

With this structure, when application of the voltage to the electromagnetic coil of the electromagnetic switching valve 30 is not done by the electronic controller, the spool valve body 33 is not forced by the push-rod 35*b*. And, as shown by a solid line in FIG. 11, the spool valve body 33 is in a state in which the spool valve body 33 is forced to a rightmost side by the spring force of the valve spring 34, and the drain port 38 is closed by the outer peripheral surface of the first land portion 33*a*. Therefore, the oil in the second control oil chamber 75 is maintained without being discharged from the drain port 38 through the discharge passage 79 and the connecting port 37.

On the other hand, when the voltage is applied to the electromagnetic coil of the electromagnetic switching valve 30 by the electronic controller, as shown by a dashed line in FIG. 11, since the spool valve body 33 is pressed by the push-rod 35*b* against the spring force of the valve spring 34 and moves in a left direction in the drawing, a part of the drain port 38 which has been closed opens.

At this time, as the pulse voltage applied to the electromagnetic coil by the electronic controller becomes higher, an opening area of the drain port 38 more increases. That is, as the pulse voltage applied to the electromagnetic coil becomes higher, an amount of the oil discharged from the second control oil chamber 75 to the pump external side through the connecting port 37 more increases.

A basic structure or configuration of the pilot valve 60 in the present embodiment is the same as that of the third embodiment. However, as changing points, one port located on the pilot pressure introduction port 66 side of two ports formed at upper and lower sides on the peripheral wall of the accommodation hole 62 in FIG. 11 has a function as a communication port 82 that communicates with the second control oil chamber 75 through a second discharge passage 81, and the other port located on the plug 64 side has a function as a drain port 83 that is a drain mechanism communicating with the atmospheric pressure outside the pump.

Operation of Fifth Embodiment

Operation of the variable displacement-type oil pump according to the fifth embodiment will be explained below.

When the oil is discharged from the outlet port 12 by and according to rotation of the drive shaft 3, a part of the discharged oil is supplied into the first control oil chamber 22 from the main oil gallery 14 through the first control oil chamber communication passage 76 etc., and also supplied into the second control oil chamber 75 from the first control oil chamber 22 through the second control oil chamber communication passage 78 and the orifice 78*a*.

At this time, in the low rotation region after the engine start, since the voltage applied to the electromagnetic coil of the electromagnetic switching valve 30 is interrupted by the electronic controller, as shown by the solid line in FIG. 11, the spool valve body 33 is not pressed by the push-rod 35*b*, and the spool valve body 33 is in the state in which the spool valve body 33 is forced to the rightmost side by the valve spring 34. The drain port 38 is therefore closed by the outer peripheral surface of the first land portion 33*a* of the spool valve body 33.

Then, the internal pressure of the first control oil chamber 22 is increased by the oil supply. And also, since the oil is supplied into and stored in the second control oil chamber 75 without being discharged from the drain port 38, an internal pressure of the second control oil chamber 75 is also increased.

As a consequence, the cam ring 6 cannot move against the spring force of the coil spring 8, and is maintained in a state in which the upper surface of the arm 19 contacts the lower surface of the upper wall of the coil spring accommodation chamber 20, i.e. in a maximum eccentric state in which the eccentric amount is a maximum.

Therefore, the main gallery pressure of the variable displacement-type oil pump in a non-operating state of the electromagnetic switching valve 30 increases substantially in proportion to increase in the engine rotation speed, in the same manner as the first embodiment (see FIG. 6).

When the main gallery pressure increases to a predetermined value or more from this state, the electromagnetic switching valve 30 works or is actuated, and the main gallery pressure is controlled to an arbitrary level such as the low pressure P1 or the middle pressure P2 shown in FIG. 6 according to the engine required pressure.

In the following description, since only a voltage value and an application timing of the pulse voltage applied to the electromagnetic coil of the electromagnetic switching valve 30 by the electronic controller are different in a pressure regulating control of the main gallery pressure by the electromagnetic switching valve 30, only a case where the main gallery pressure is controlled to the low pressure P1 will be explained, and other cases will be omitted.

In a case where the main gallery pressure is controlled or adjusted (regulated) to the low pressure P1, when the main gallery pressure increasing according to increase in the engine rotation speed reaches the low pressure P1, energization of the electromagnetic coil of the electromagnetic switching valve 30 from the electronic controller (application of the voltage to the electromagnetic coil of the electromagnetic switching valve 30 by the electronic controller) is started. Then, as shown by the dashed line in FIG. 11, the spool valve body 33 is pressed by the push-rod 35*b*, and moves to the left side in the drawing against the spring force of the valve spring 34, and the drain port 38 communicates with the connecting port 37.

Then, since a part of the oil in the second control oil chamber 75 is discharged to the external side through the discharge passage 79, the connecting port 37, the annular passage 40 and the drain port 38, the internal pressure of the second control oil chamber 75 is decreased.

With this, the hydraulic pressure acting on the receiving surface 26 in the first control oil chamber 22 becomes greater than the sum of the hydraulic pressure acting on the second pressure receiving surface 80 in the second control oil chamber 75 and the spring force of the coil spring 8, and the cam ring 6 rotates (moves) in the concentric direction against the spring force of the coil spring 8, thereby preventing the main gallery pressure from becoming the low pressure P1 or more.

On the other hand, when the main gallery pressure is lower than the low pressure P1 by decrease in the eccentric amount of the cam ring 6, the pulse voltage applied to the electromagnetic coil is slightly decreased by the electronic controller, and the spool valve body 33 slightly moves to the right side in the drawing.

Then, since the opening area of the drain port 38 is decreased, an amount of the oil discharged from the second control oil chamber 75 to the external side is decreased. With this, the hydraulic pressure of the second control oil chamber 75 is increased, and the eccentric amount of the cam ring 6 is increased according to this pressure increase of the second control oil chamber 75. The main gallery pressure is then increased again.

In this manner, by controlling (increasing and decreasing) the opening area of the drain port 38 according to the sliding movement of the spool valve body 33, the variable displacement-type oil pump can properly control or adjust (increase and decrease) the internal pressure of the second control oil chamber 75, and control or adjust (regulate) the main gallery pressure to the low pressure P1 as shown in FIG. 6.

Further, also by the pilot valve 60 in the present embodiment, in the same manner as the control valve 50 of the first embodiment, instead of the electromagnetic switching valve 30, the main gallery pressure can be controlled to the high pressure P3.

That is, in the present embodiment, when controlling the main gallery pressure to the high pressure P3, since the voltage applied to the electromagnetic coil of the electromagnetic switching valve 30 is interrupted by the electronic controller, as shown by the solid line in FIG. 11, the spool valve body 33 is not pressed by the push-rod 35*b*, and the spool valve body 33 is in the state in which the spool valve body 33 is always forced to the rightmost side.

Then, since communication of the connecting port 37 with the drain port 38 is interrupted by the first land portion 33*a* of the spool valve body 33, the oil in the second control oil chamber 75 is not discharged, and the cam ring 6 is always positioned at a maximum eccentric position.

Therefore, although the variable displacement-type oil pump shows the hydraulic pressure characteristics shown in FIG. 6 in which the main gallery pressure is gradually increased as the engine rotation speed increases, when this main gallery pressure reaches the high pressure P3, the pilot valve 60 works or is actuated, then the control (pressure regulation) of the main gallery pressure is carried out.

More specifically, when the engine rotation speed is low and the main gallery pressure (the pilot pressure) acting on the pressure receiving portion 63*d* of the spool valve body 63 is small, as shown in FIG. 11, the pilot valve 60 is maintained in a state in which the top end edge of the pressure receiving portion 63*d* is seated on the seating surface 62*a* by the spring force of the control spring 65. However, when the main gallery pressure reaches the high pressure P3 according to increase in the engine rotation speed, as shown in FIG. 12, the pressure receiving portion 63*d* receives the high pressure P3, and the spool valve body 63 moves to the plug 64 side against the spring force of the control spring 65.

Then, since the communication port 82 and the drain port 83 communicate with each other, the oil in the second control oil chamber 75 is discharged to the pump external side through the second discharge passage 81, the drain port 83, the annular passage 71 and the drain port 83.

With this, as shown in FIG. 12, the cam ring 6 moves in the concentric direction against the spring force of the coil spring 8, thereby preventing the main gallery pressure from becoming the high pressure P3 or more.

On the other hand, when the main gallery pressure is lower than the high pressure P3 by decrease in the eccentric amount of the cam ring 6, since a force acting on the pressure receiving portion 63*d* also becomes small, the spool valve body 63 is pressed by the control spring 65 and slightly moves upward from a state of FIG. 12.

Then, since an opening area of the drain port 83 to the annular passage 71 is decreased, an amount of the oil discharged from the second control oil chamber 75 to the external side is decreased. And, since the hydraulic pressure in the second control oil chamber 75 is increased (the oil in the second control oil chamber 75 is pressurized), the eccentric amount of the cam ring 6 is increased, and the main gallery pressure is increased again.

As described above, according to the present embodiment, by controlling (increasing and decreasing) the opening area of the drain port 83 by a slight sliding movement of the spool valve body 63 according to variation of the main gallery pressure in an operating state of the pilot valve 60 without operation or working of the electromagnetic switching valve 30, the variable displacement-type oil pump can properly control or adjust (increase and decrease) the internal pressure of the second control oil chamber 75, and control or adjust (regulate) the main gallery pressure to the high pressure P3 as shown in FIG. 6.

Further, in the present embodiment, since the first control oil chamber 22 and the second control oil chamber 75 are arranged at opposite sides of the cam ring reference line M (the pivot pin 10) in the outer circumferential area of the cam ring 6, unintentional rock or vibration of the cam ring 6 when babble (aeration) is generated in the oil and the hydraulic pressure of the cam ring 6 (the hydraulic pressure in each pump chamber 7) is decreased can be suppressed.

Sixth Embodiment

Figure 13:
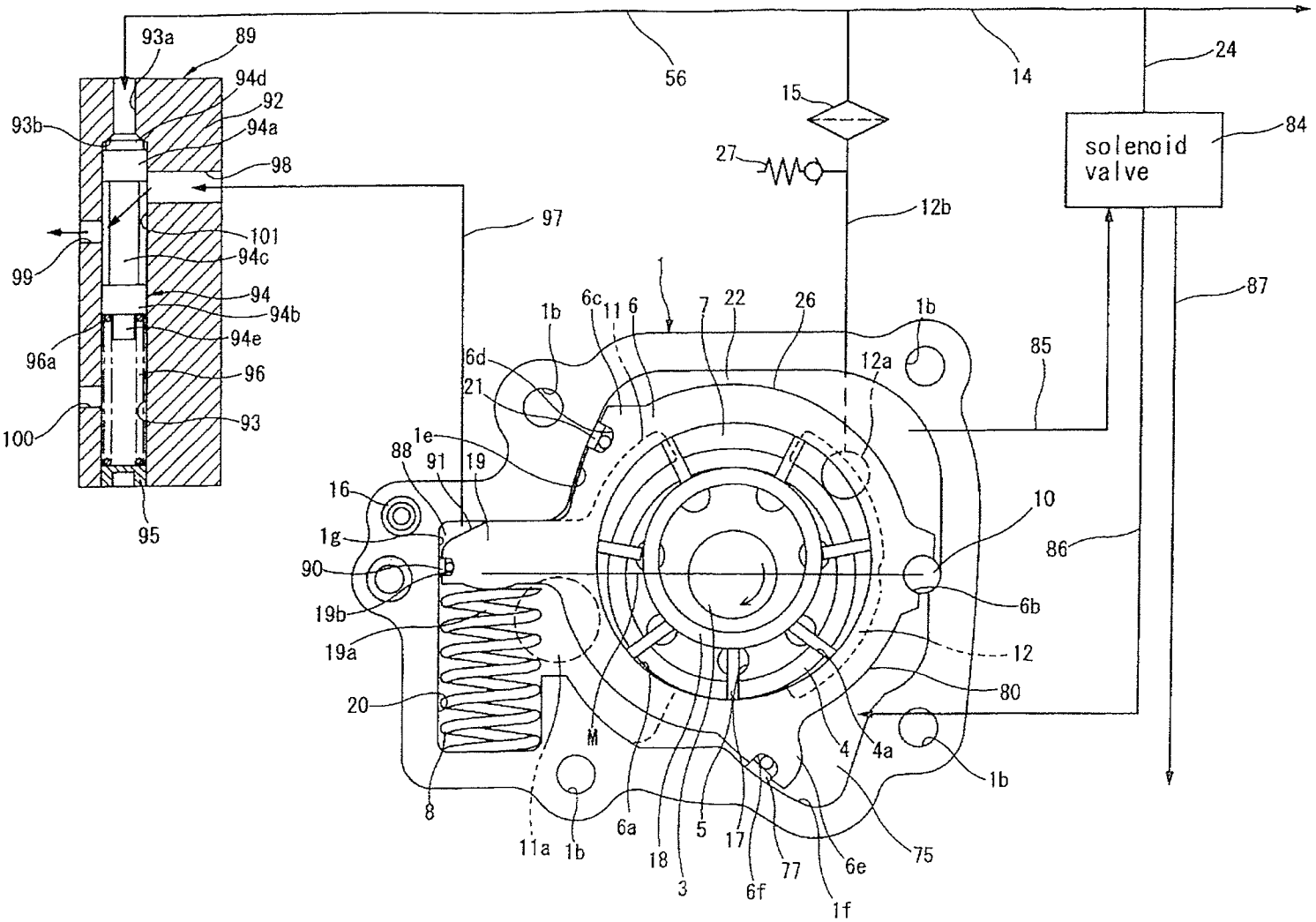
FIG. 13 is a schematic view of the variable displacement-type oil pump according to a sixth embodiment.
Figure 14:
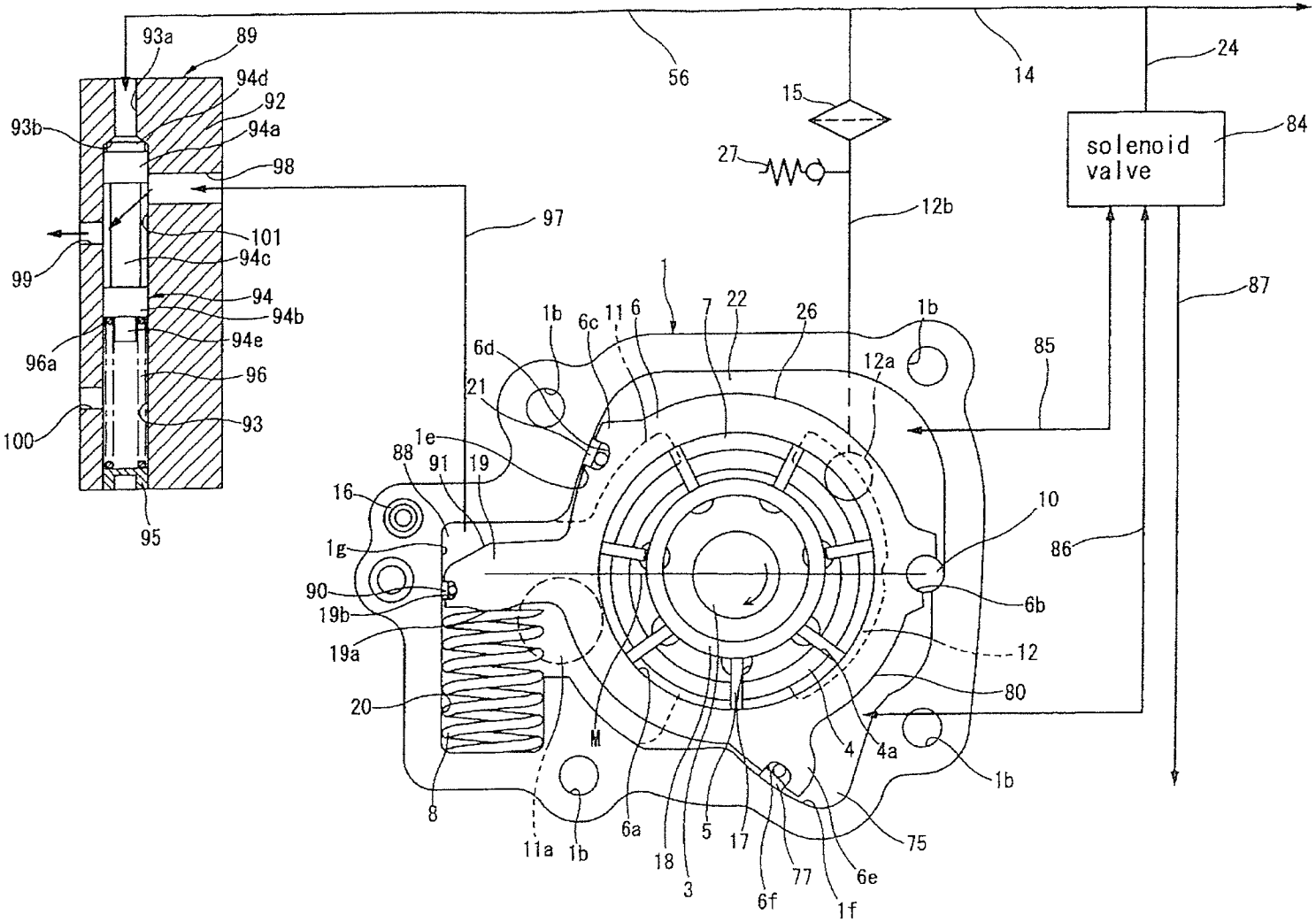
FIG. 14 is a drawing for explaining working of the variable displacement-type oil pump when adjusting the main gallery pressure by a solenoid valve.
Figure 15:
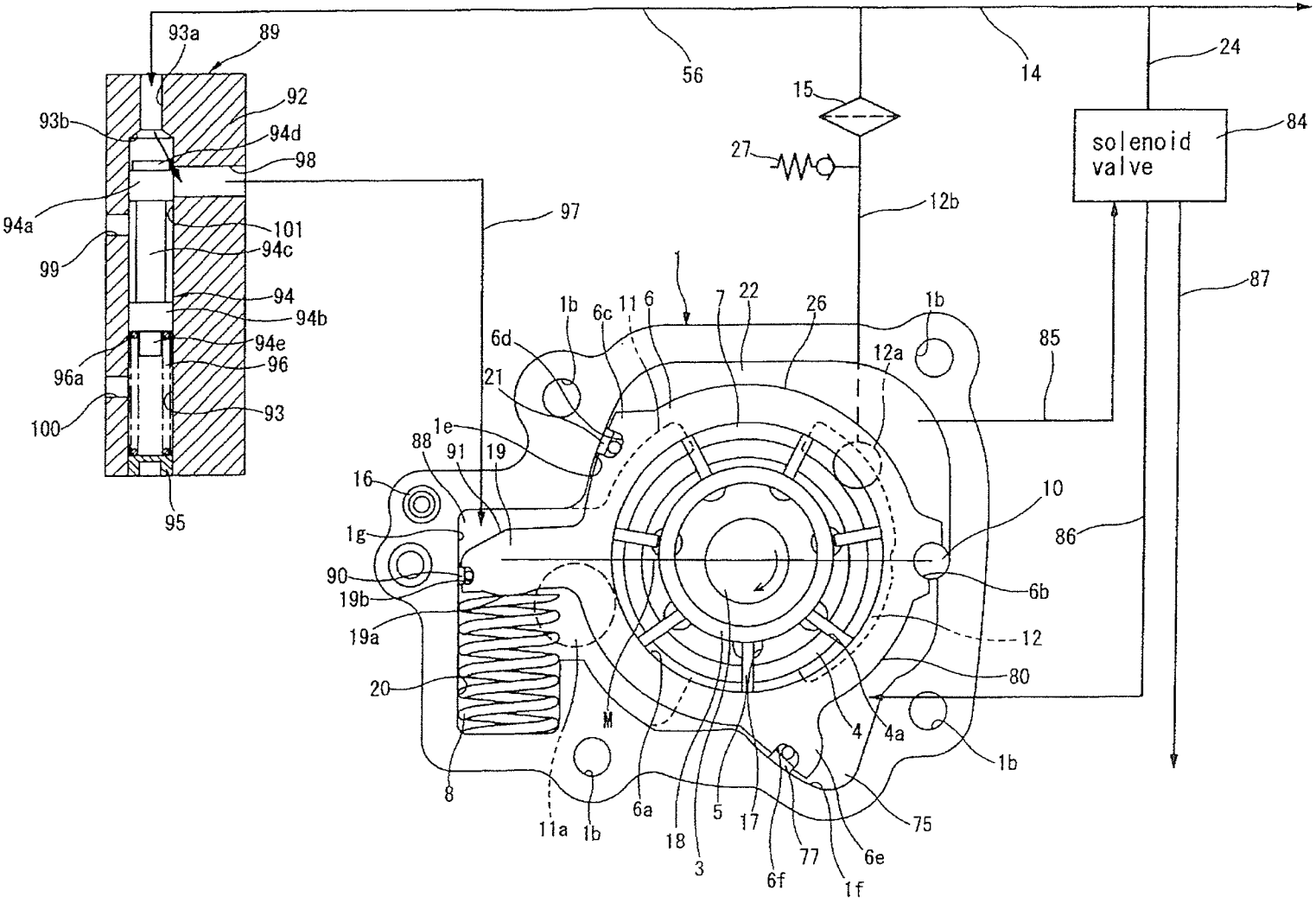
FIG. 15 is a drawing for explaining working of the variable displacement-type oil pump when adjusting the main gallery pressure by a control valve.

FIGS. 13 to 15 illustrate a sixth embodiment of the present invention. A basic structure or configuration of the sixth embodiment is the substantially same as that of the fifth embodiment. However, in the sixth embodiment, the pressure control of the first control oil chamber 22 and the second control oil chamber 75 is performed by a solenoid valve 84 as an electrical control mechanism which is different from the fifth embodiment.

This solenoid valve 84 works or is actuated by the pulse voltage outputted from the electronic controller (not shown), in the same manner as the electromagnetic switching valve 30. The solenoid valve 84 is configured so that, in an OFF state in which the pulse voltage is not applied to the solenoid valve 84 by the electronic controller, as shown in FIG. 13, the oil introduced into the solenoid valve 84 from the main oil gallery 14 through the branch passage 24 is supplied into the second control oil chamber 75 through a second control oil chamber supply and discharge passage 86, and also the oil in the first control oil chamber 22 is discharged to the pump external side through a first control oil chamber supply and discharge passage 85 and a drain passage 87.

On the other hand, the solenoid valve 84 is configured so that, in an ON state in which the pulse voltage is applied to the solenoid valve 84 by the electronic controller, as shown in FIG. 14, the solenoid valve 84 controls or adjusts a relationship of the hydraulic pressures of the first control oil chamber 22 and the second control oil chamber 75 by properly supplying the oil to the first control oil chamber 22 and the second control oil chamber 75 through the first and second control oil chamber supply and discharge passages 85 and 86 according to a duty ratio of the pulse voltage and by discharging the oil in the first control oil chamber 22 and the second control oil chamber 75 to the pump external side through the first and second control oil chamber supply and discharge passages 85 and 86 and the drain passage 87.

Here, in the same way of controlling the electromagnetic switching valve 30, the electronic controller in the present embodiment is configured so that, in a state in which the engine is in the low rotation region, the electronic controller does not apply the pulse voltage to the solenoid valve 84, while when the engine reaches a predetermined high rotation region, the electronic controller applies the pulse voltage to the solenoid valve 84 in order for the solenoid valve 84 to control the main gallery pressure to an arbitrary setting pressure.

With this configuration, also the variable displacement-type oil pump of the present invention can obtain the same hydraulic pressure characteristics shown in FIG. 6 as those of the first embodiment.

Here, the electronic controller is configured to, during working (or operation) of an after-mentioned control valve 89, maintain a non-energization state in which the pulse voltage is not applied to the solenoid valve 84. With this, the solenoid valve 84 is configured so that, during the working (or the operation) of the control valve 89, the solenoid valve 84 is maintained in the OFF state all the time.

In the present embodiment, the variable displacement-type oil pump further has a third control oil chamber 88 as a second decrease side control oil chamber in the outer circumferential area of the cam ring 6. The third control oil chamber 88 is provided with the control valve 89 that, when the main gallery pressure reaches the high pressure P3, works and controls the main gallery pressure on the basis of pressure control of the third control oil chamber 88 instead of the solenoid valve 84.

When providing the third control oil chamber 88, a top end portion of the arm 19 formed integrally with cam ring 6 is slightly extended in a radial direction of the cam ring 6 as compared with that of the fifth embodiment. A third seal groove 19*b* formed by being cut along an axial direction of the cam ring 6 and having a substantially arc-shape in cross section is provided at a tip edge of the top end portion. Further, a third seal member 90 which is made of synthetic resin material having low abrasion property and has a straight shape is accommodated in this third seal groove 19*b*.

The third seal member 90 is disposed in the third seal groove 19*b* along the axial direction of the cam ring 6. The third seal member 90 is pressed against a third seal sliding contact surface 1*g* by an elastic force of an elastic member made of rubber and provided at a bottom of the third seal groove 19*b*, and always secures good sealing performance between the third seal member 90 and the third seal sliding contact surface 1*g*.

The third control oil chamber 88 is arranged at an upper side with respect to the cam ring reference line M in FIG. 13. The third control oil chamber 88 is defined by the inner circumferential surface of the pump housing 1, the outer circumferential surface of the cam ring 6, the upper surface of the arm 19, the seal member 21, the third seal member 90, the bottom surface of the pump accommodation chamber 1*a* and the inner side surface of the pump cover 2.

The outer circumferential surface of the cam ring 6 and the upper surface of the arm 19, which form the third control oil chamber 88, are formed as a third pressure receiving surface 91 receiving the hydraulic pressure of the oil. Therefore, the third control oil chamber 88 is configured so that when the oil is supplied to an inside of the third control oil chamber 88, the hydraulic pressure of this oil acts on the third pressure receiving surface 91 and the cam ring 6 is pushed or pressed against the spring force of the coil spring 8 in the concentric direction, i.e. in the direction in which the volume variation of each of the plurality of pump chambers 7 is decreased.

The control valve 89 is formed by mainly a valve housing 92 fixed to the outer side surface of the pump housing 1, an accommodation hole 93 having a circular shape in cross section and provided at the valve housing 92, a spool valve body 94 provided in the accommodation hole 93 so as to be able to slide along an axial direction of the accommodation hole 93, a bowl-shaped plug 95 press-fitted into an opening at one end side of the accommodation hole 93, and a control spring 96 elastically set between the plug 95 and the spool valve body 94.

The accommodation hole 93 communicates with the main oil gallery 14 through a relatively small diameter control hydraulic pressure introduction port 93*a* formed at an upper end wall of the valve housing 92 and the control hydraulic pressure introduction passage 56. The main gallery pressure is introduced into the accommodation hole 93 as a control hydraulic pressure from the main oil gallery 14.

On a peripheral wall of the accommodation hole 93, in an order from the control hydraulic pressure introduction port 93*a* side to the plug 95 side, a communication port 98 that communicates with the third control oil chamber 88 through a third control oil chamber supply and discharge passage 97, a drain port 99 that communicates with the atmospheric pressure outside the pump, and an air vent 100 for securing good sliding performance of the spool valve body 94, are each formed along a radial direction.

Further, the accommodation hole 93 is provided with a stepped tapered seating surface 93*b* between the control hydraulic pressure introduction port 93*a* and the accommodation hole 93. When after-mentioned pressure receiving portion 94*d* of the spool valve body 94 is seated on this seating surface 93*b*, communication of the accommodation hole 93 with the control hydraulic pressure introduction port 93*a* is interrupted.

The spool valve body 94 has a large diameter cylindrical first land portion 94*a* provided at the control hydraulic pressure introduction port 93*a* side, a large diameter cylindrical second land portion 94*b* provided at the plug 95 side, and a cylindrical small diameter shaft portion 94*c* having a relatively small diameter and connecting the both land portions 94*a* and 94*b*.

The first and second land portions 94*a* and 94*b* are formed so as to have a substantially same outside diameter, and are each in sliding contact with an inner peripheral surface of the accommodation hole 93 with a slight gap provided.

At an outer peripheral side of the small diameter shaft portion 94*c*, an annular passage 101 is defined by an outer peripheral surface of the small diameter shaft portion 94*c*, opposing inner end surfaces of the first and second land portions 94*a* and 94*b* and the inner peripheral surface of the accommodation hole 93.

Further, the protruding cylindrical pressure receiving portion 94*d* having a relatively small diameter is provided at an end surface at the control hydraulic pressure introduction port 93*a* side of the first land portion 94*a*. A pressure receiving area at a top end surface of this pressure receiving portion 94*d* is formed into a flat shape, and receives the main gallery pressure supplied to the control hydraulic pressure introduction port 93*a* from the main oil gallery 14.

Furthermore, a small diameter cylindrical protrusion 94*e* that retains one end portion 96*a* of the control spring 96 is provided on an end surface at the plug 95 side of the second land portion 94*b*.

The control valve 89 is configured to control a flow of the oil by upward and downward movements of the spool valve body 94 by a relative difference between the main gallery pressure which the pressure receiving portion 94*d* receives through the control hydraulic pressure introduction port 93*a* and a spring force of the control spring 96. This specific opening and closing operation will be explained in the following working and effect of the present embodiment.

Working and Effect of Sixth Embodiment

According to the present embodiment, as described above, the main gallery pressure can be controlled to an arbitrary setting pressure by the solenoid valve 84. Further, also in the present embodiment, when controlling the main gallery pressure to the high pressure P3, the pressure control of the main gallery pressure can be carried out using the control valve 89 instead of the solenoid valve 84.

This will be explained in more detail. In the present embodiment, in a case where the main gallery pressure is controlled to the high pressure P3, i.e. in a case where the control valve 89 works or is actuated, as mentioned above, since the solenoid valve 84 is set to the OFF state, as shown in FIG. 13, the first control oil chamber 22 is maintained in a discharge state in which the oil in the first control oil chamber 22 is discharged to the pump external side through the first control oil chamber supply and discharge passage 85, the an inside of the solenoid valve 84 and the drain passage 87. And, the second control oil chamber 75 is maintained in a supply state in which the main gallery pressure is supplied into the second control oil chamber 75 through the inside of the solenoid valve 84 and the second control oil chamber supply and discharge passage 86.

Therefore, the cam ring 6 is maintained in a state in which the cam ring 6 is forced in the eccentric direction by the spring force of the coil spring 8 and the hydraulic pressure acting on the second control oil chamber 75. Then, although the main gallery pressure increases substantially in proportion to increase in the engine rotation speed, when this main gallery pressure reaches the high pressure P3, the control valve 89 works or is actuated, and the control of the main gallery pressure is carried out.

That is, when the engine rotation speed is low and the main gallery pressure acting on the pressure receiving portion 94*d* is small, as shown in FIG. 13, the control valve 89 is maintained in a state in which a top end edge of the pressure receiving portion 94*d* is seated on the seating surface 93*b* by a spring force of the control spring 96. However, when the main gallery pressure reaches the high pressure P3 by the increase in the engine rotation speed, as shown in FIG. 15, the pressure receiving portion 94*d* receives the high pressure P3, and the spool valve body 94 moves to the plug 95 side against the spring force of the control spring 96.

Then, since the control hydraulic pressure introduction port 93*a* and the communication port 98 communicate with each other, the oil flowing in the main oil gallery 14 is supplied into the third control oil chamber 88 through the control hydraulic pressure introduction passage 56, the control hydraulic pressure introduction port 93*a*, the accommodation hole 93, the communication port 98 and the third control oil chamber supply and discharge passage 97.

With this, as shown in FIG. 15, the cam ring 6 moves in the concentric direction against the spring force of the coil spring 8 and the hydraulic pressure acting on the second control oil chamber 75, thereby preventing the main gallery pressure from becoming the high pressure P3 or more.

On the other hand, when the main gallery pressure is lower than the high pressure P3 by decrease in the eccentric amount of the cam ring 6, since a force acting on the pressure receiving portion 94*d* also becomes small, the spool valve body 94 is pressed by the control spring 96 and slightly moves upward from a state of FIG. 15.

Then, communication of the control hydraulic pressure introduction port 93*a* with the communication port 98 is interrupted by an outer peripheral surface of the first land portion 94*a*, while the communication port 98 communicates with the drain port 99 through the annular passage 101. With this, since the hydraulic pressure of the third control oil chamber 88 is decrease, the eccentric amount of the cam ring 6 is increased, and the main gallery pressure is increased again.

As described above, according to the present embodiment, by properly controlling (increasing and decreasing) the internal pressure of the third control oil chamber 88 by a slight sliding movement of the control valve 89 (the spool valve body 94) according to variation of the main gallery pressure in an operating state of the control valve 89 without operation or working of the solenoid valve 84, the variable displacement-type oil pump can control or adjust (regulate) the main gallery pressure to the high pressure P3 as shown in FIG. 6.

Hence, also by the present embodiment, in the same manner as the first embodiment, electric power consumption associated with the solenoid valve 84 can be reduced. Further, since the main gallery pressure is used as the control hydraulic pressure of the control valve 89, wobble or vibration of the spool valve body 94 is suppressed, and a stable pressure control can be achieved, which is the same as the first embodiment.

Here, in the present embodiment, the first control oil chamber 22 is arranged at an opposite position to the second control oil chamber 75 with respect to the cam ring reference line M, and the third control oil chamber 88 is arranged at an opposite position to the coil spring 8 with respect to the cam ring reference line M. However, even if positions of these first and third control oil chambers 22 and 88 are changed, the same working and effect can be obtained.

Further, in the present embodiment, the third control oil chamber 88 is supplied with the main gallery pressure. However, as long as the control hydraulic pressure for controlling the control valve 89 is the main gallery pressure, the hydraulic pressure supplied into the third control oil chamber 88 could be the discharge pressure.

Seventh Embodiment

Figure 16:
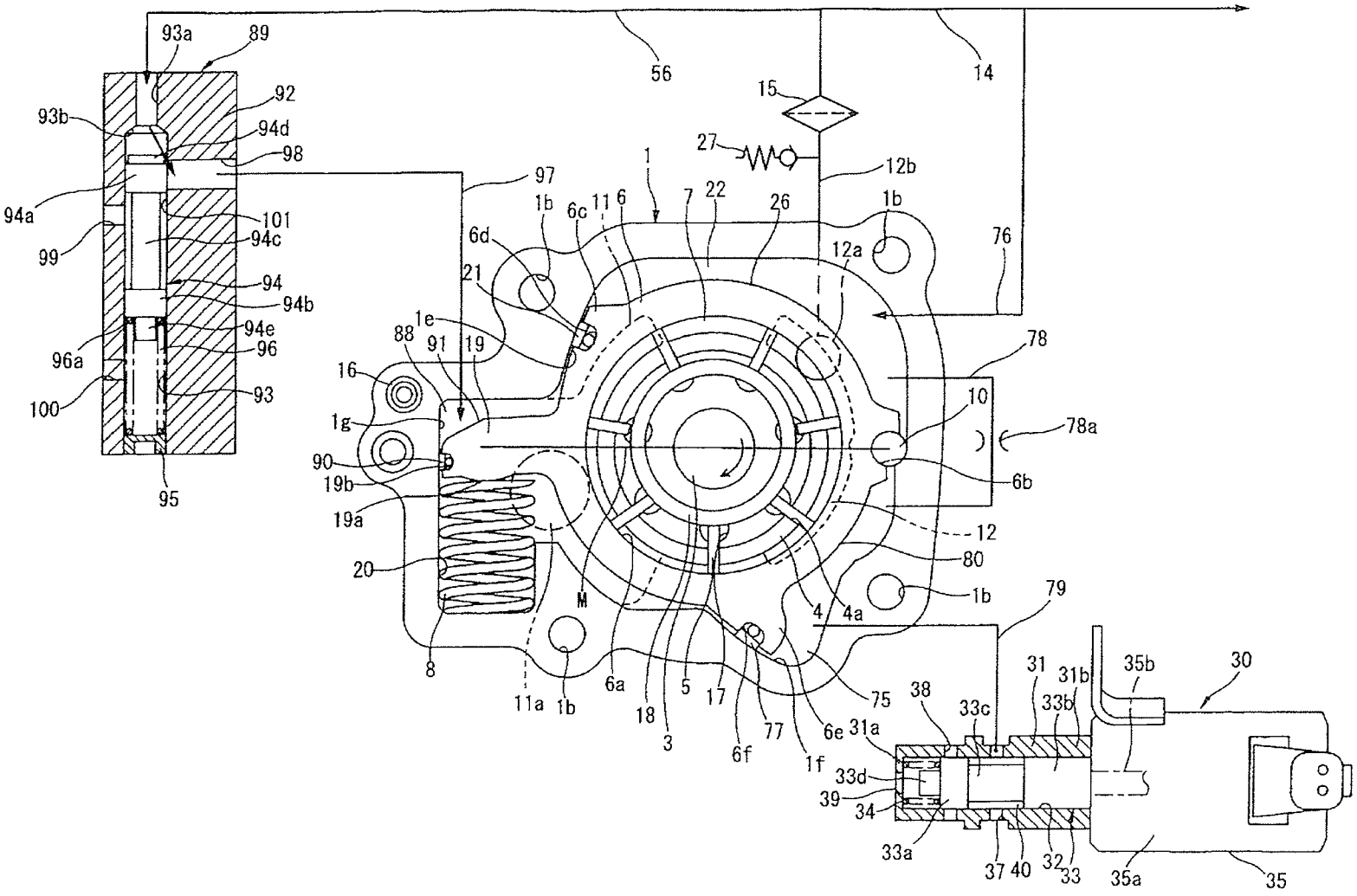
FIG. 16 is a schematic view of the variable displacement-type oil pump according to a seventh embodiment.

FIG. 16 illustrates a seventh embodiment of the present invention. A basic structure or configuration of the seventh embodiment is the same as that of the sixth embodiment. However, in the seventh embodiment, the pressure regulating control of the first and second control oil chambers 22 and 75 is performed by not the solenoid valve 84 but the electromagnetic switching valve 30. Further, by this change, each passage connecting the first and second control oil chambers 22 and 75 and the electromagnetic switching valve 30 is changed to the same configuration as that of the fifth embodiment.

That is, since only the solenoid valve 84 is changed to the electromagnetic switching valve 30 having the same working and effect in the present embodiment, the present embodiment can obtain the same working and effect as those of the first embodiment.

Here, also in the present embodiment, in the same manner as the sixth embodiment, the hydraulic pressure supplied into the third control oil chamber 88 could be changed to the discharge pressure from the main gallery pressure.

As the variable displacement-type oil pump based on the embodiments explained above, for instance, the followings are raised.

As one aspect of the present invention, a variable displacement-type oil pump comprises: a pump configuration unit that is driven and rotates by an engine and discharges oil sucked from an inlet portion from an outlet portion by volumes of a plurality of pump chambers being varied; a movable member that is able to change a volume variation of each of the plurality of pump chambers by movement of the movable member; a forcing mechanism that is installed with a set load provided and forces the movable member in a direction in which the volume variation of each of the plurality of pump chambers is increased; one or more control oil chambers that changes the volume variation of each of the plurality of pump chambers, the control oil chambers including at least a decrease side control oil chamber that exerts a force on the movable member in a direction in which the volume variation of each of the plurality of pump chambers is decreased by being supplied with the oil discharged from the outlet portion; a drain mechanism that discharges the oil from specified one control oil chamber among the control oil chambers; an electrical control mechanism that is able to regulate a discharge pressure, which is a hydraulic pressure of the oil discharged from the outlet portion, to a plurality of setting pressures by controlling supply and discharge of the oil discharged from the outlet portion to and from the specified one control oil chamber on the basis of an electric signal and adjusting an internal pressure of the specified one control oil chamber; and a control valve into which a downstream side oil discharged from the outlet portion is introduced as a control pressure, the control valve configured to, when a hydraulic pressure of the introduced oil exceeds a predetermined setting working pressure, adjust the internal pressure of the specified one control oil chamber by supplying the oil discharged from the outlet portion into the specified one control oil chamber or discharging the oil from the specified one control oil chamber.

As a preferable aspect of the variable displacement-type oil pump, the oil supplied into the decrease side control oil chamber is the downstream side oil discharged from the outlet portion.

As another preferable aspect of the variable displacement-type oil pump, the specified one control oil chamber is the decrease side control oil chamber.

As another preferable aspect of the variable displacement-type oil pump, the drain mechanism is provided at the electrical control mechanism.

As another preferable aspect of the variable displacement-type oil pump, the drain mechanism is provided at a pump housing that accommodates therein the pump configuration unit.

As another preferable aspect of the variable displacement-type oil pump, the drain mechanism is provided at the control valve.

As another preferable aspect of the variable displacement-type oil pump, the specified one control oil chamber is an increase side control oil chamber that exerts a force on the movable member in a direction in which the volume variation of each of the plurality of pump chambers is increased by being supplied with the oil discharged from the outlet portion.

As another preferable aspect of the variable displacement-type oil pump, the increase side control oil chamber is supplied with the downstream side oil discharged from the outlet portion through the decrease side control oil chamber, and the electrical control mechanism controls discharge of the oil from the increase side control oil chamber.

As another preferable aspect of the variable displacement-type oil pump, the oil supplied into the decrease side control oil chamber is an upstream side oil of the outlet portion.

As another preferable aspect of the variable displacement-type oil pump, when the control valve works, the electrical control mechanism is set to an OFF state.

As another preferable aspect of the variable displacement-type oil pump, the setting working pressure of the control valve is set within a pressure region that is equal to or greater than a maximum requiring pressure which the engine requires.

From the other view point, a variable displacement-type oil pump comprises: a pump configuration unit that is driven and rotates by an engine and discharges oil sucked from an inlet portion from an outlet portion by volumes of a plurality of pump chambers being varied; a movable member that is able to change a volume variation of each of the plurality of pump chambers by movement of the movable member; a forcing mechanism that is installed with a set load provided and forces the movable member in a direction in which the volume variation of each of the plurality of pump chambers is increased; a first control oil chamber that exerts a force on the movable member in a direction in which the volume variation of each of the plurality of pump chambers is decreased by being supplied with the oil discharged from the outlet portion; a second control oil chamber that exerts a force on the movable member in a direction in which the volume variation of each of the plurality of pump chambers is increased by being supplied with the oil discharged from the outlet portion; an electrical control mechanism that is able to regulate a discharge pressure, which is a hydraulic pressure of the oil discharged from the outlet portion, to a plurality of setting pressures by performing supply and discharge of the oil discharged from the outlet portion to and from each of the first and second control oil chambers on the basis of an electric signal and controlling a relationship of hydraulic pressures of the first and second control oil chambers; a third control oil chamber that exerts a force on the movable member in a direction in which the volume variation of each of the plurality of pump chambers is decreased by being supplied with the oil discharged from the outlet portion; and a control valve into which a downstream side oil discharged from the outlet portion is introduced as a control pressure, the control valve configured to, when a hydraulic pressure of the introduced oil exceeds a predetermined setting working pressure, adjust an internal pressure of the third control oil chamber by supplying the oil discharged from the outlet portion into the third control oil chamber or discharging the oil from the third control oil chamber.

As a preferable aspect of the variable displacement-type oil pump, the oil supplied into the third control oil chamber is the downstream side oil discharged from the outlet portion.

As another preferable aspect of the variable displacement-type oil pump, the oil supplied into the third control oil chamber is an upstream side oil of the outlet portion.

As another preferable aspect of the variable displacement-type oil pump, when the control valve works, the electrical control mechanism is set to an OFF state.

As another preferable aspect of the variable displacement-type oil pump, the setting working pressure of the control valve is set within a pressure region that is equal to or greater than a maximum requiring pressure which the engine requires.

From the other view point, a variable displacement-type oil pump comprises: a rotor that is driven and rotates by an internal combustion engine; a plurality of vanes that are accommodated at an outer periphery of the rotor so as to be able to extend and retract; a cam ring that defines a plurality of pump chambers by accommodating the rotor and the vanes at an inner circumferential side of the cam ring, and increases and decreases a volume variation of each of the plurality of pump chambers by an eccentric movement of the cam ring with respect to the rotor; an inlet portion that is formed in an inlet area where an inside volume of the pump chamber is increased; an outlet portion that is formed in an outlet area where the inside volume of the pump chamber is decreased; a forcing mechanism that is installed with a pre-load provided and forces the cam ring in a direction in which the volume variation of each of the plurality of pump chambers is increased; one or more control oil chambers that changes the volume variation of each of the plurality of pump chambers, the control oil chambers including at least a decrease side control oil chamber that exerts a force on the cam ring in a direction in which the volume variation of each of the plurality of pump chambers is decreased by being supplied with the oil discharged from the outlet portion; a drain mechanism that discharges the oil from specified one control oil chamber among the control oil chambers; an electrical control mechanism that is able to regulate a discharge pressure, which is a hydraulic pressure of the oil discharged from the outlet portion, to a plurality of setting pressures by controlling supply and discharge of the oil discharged from the outlet portion to and from the specified one control oil chamber on the basis of an electric signal and adjusting an internal pressure of the specified one control oil chamber; and a control valve into which a downstream side oil discharged from the outlet portion is introduced as a control pressure, the control valve configured to, when a hydraulic pressure of the introduced oil exceeds a predetermined setting working pressure, adjust the internal pressure of the specified one control oil chamber by supplying the oil discharged from the outlet portion into the specified one control oil chamber or discharging the oil from the specified one control oil chamber.

The invention claimed is:

1. A variable displacement oil pump comprising:

a pump configuration unit that is driven and rotates by an engine and discharges oil sucked from an inlet portion to an outlet portion by volumes of a plurality of pump chambers being varied;

a movable member that is able to change a volume variation of each of the plurality of pump chambers by movement of the movable member;

a forcing mechanism, having a set load provided, that forces the movable member in a direction in which the volume variation of each of the plurality of pump chambers is increased;

one or more control oil chambers that changes the volume variation of each of the plurality of pump chambers, the control oil chambers including at least a decrease side control oil chamber that exerts a force on the movable member in a direction in which the volume variation of each of the plurality of pump chambers is decreased by being supplied with the oil discharged from the outlet portion;

a drain mechanism that discharges the oil from specified one control oil chamber among the control oil chambers;

an electrical control mechanism into which a downstream side oil discharged from the outlet portion and passing through an oil filter provided on a discharge passage connected to the outlet portion is introduced and which is able to regulate a discharge pressure, which is a hydraulic pressure of the oil discharged from the outlet portion, to a plurality of setting pressures by controlling supply and discharge of the oil discharged from the outlet portion to and from the specified one control oil chamber on the basis of an electric signal and adjusting an internal pressure of the specified one control oil chamber, the electrical control mechanism configured to, when not being energized, not introduce oil to the specified one control oil chamber; and a control valve into which the downstream side oil discharged from the outlet portion and passing through the oil filter and without passing through the electrical control mechanism is introduced as a control pressure, the control valve configured to, when a hydraulic pressure of the introduced oil exceeds a predetermined setting working pressure, adjust the internal pressure of the specified one control oil chamber by supplying the oil discharged from the outlet portion into the specified one control oil chamber or discharging the oil from the specified one control oil chamber.

2. The variable displacement oil pump as claimed in claim 1, wherein:

the oil supplied into the decrease side control oil chamber is the downstream side oil discharged from the outlet portion.

3. The variable displacement oil pump as claimed in claim 2, wherein:

the specified one control oil chamber is the decrease side control oil chamber.

4. The variable displacement oil pump as claimed in claim 3, wherein:

the drain mechanism is provided at the electrical control mechanism.

5. The variable displacement oil pump as claimed in claim 3, wherein:

the drain mechanism is provided at a pump housing that accommodates therein the pump configuration unit.

6. The variable displacement oil pump as claimed in claim 3, wherein:

the drain mechanism is provided at the control valve.

7. The variable displacement oil pump as claimed in claim 2, wherein:

the specified one control oil chamber is an increase side control oil chamber that exerts a force on the movable member in a direction in which the volume variation of each of the plurality of pump chambers is increased by being supplied with the oil discharged from the outlet portion.

8. The variable displacement oil pump as claimed in claim 7, wherein:

the increase side control oil chamber is supplied with the downstream side oil discharged from the outlet portion through the decrease side control oil chamber, and the electrical control mechanism controls discharge of the oil from the increase side control oil chamber.

9. The variable displacement oil pump as claimed in claim 1, wherein:

the oil supplied into the decrease side control oil chamber is an upstream side oil of the outlet portion.

10. The variable displacement oil pump as claimed in claim 1, wherein:

when the control valve works, the electrical control mechanism is set to an OFF state.

11. The variable displacement oil pump as claimed in claim 10, wherein:

the setting working pressure of the control valve is set within a pressure range that is equal to or greater than a maximum requiring pressure which the engine requires.

12. A variable displacement oil pump comprising:

a rotor that is driven and rotates by an internal combustion engine;

a plurality of vanes that are accommodated at an outer periphery of the rotor so as to be able to extend and retract;

a cam ring that defines a plurality of pump chambers by accommodating the rotor and the vanes at an inner circumferential side of the cam ring, and increases and decreases a volume variation of each of the plurality of pump chambers by an eccentric movement of the cam ring with respect to the rotor;

an inlet portion that is formed in an inlet area where an inside volume of the pump chamber is increased;

an outlet portion that is formed in an outlet area where the inside volume of the pump chamber is decreased;

a forcing mechanism, having a pre-load provided, that forces the cam ring in a direction in which the volume variation of each of the plurality of pump chambers is increased;

one or more control oil chambers that changes the volume variation of each of the plurality of pump chambers, the control oil chambers including at least a decrease side control oil chamber that exerts a force on the cam ring in a direction in which the volume variation of each of the plurality of pump chambers is decreased by being supplied with the oil discharged from the outlet portion;

a drain mechanism that discharges the oil from specified one control oil chamber among the control oil chambers;

an electrical control mechanism into which a downstream side oil discharged from the outlet portion and passing through an oil filter provided on a discharge passage connected to the outlet portion is introduced and which is able to regulate a discharge pressure, which is a hydraulic pressure of the oil discharged from the outlet portion, to a plurality of setting pressures by controlling supply and discharge of the oil discharged from the outlet portion to and from the specified one control oil chamber on the basis of an electric signal and adjusting an internal pressure of the specified one control oil chamber, the electrical control mechanism configured to, when not being energized, not introduce oil to the specified one control oil chamber; and a control valve into which the downstream side oil discharged from the outlet portion and passing through the oil filter and without passing through the electrical control mechanism is introduced as a control pressure, the control valve configured to, when a hydraulic pressure of the introduced oil exceeds a predetermined setting working pressure, adjust the internal pressure of the specified one control oil chamber by supplying the oil discharged from the outlet portion into the specified one control oil chamber or discharging the oil from the specified one control oil chamber.

* * * * *